US006525477B2

(12) United States Patent
Small

(10) Patent No.: US 6,525,477 B2
(45) Date of Patent: Feb. 25, 2003

(54) OPTICAL MAGNETRON GENERATOR

(75) Inventor: James G. Small, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 51 days.

(21) Appl. No.: 09/867,076

(22) Filed: May 29, 2001

(65) Prior Publication Data

US 2002/0190656 A1 Dec. 19, 2002

(51) Int. Cl.[7] ..... H01J 25/50
(52) U.S. Cl. ..... 315/39.51; 315/39.77
(58) Field of Search ..... 315/39.51, 39.53, 315/39.65, 39.75, 39.77

(56) References Cited

U.S. PATENT DOCUMENTS

| | | | | |
|---|---|---|---|---|
| 3,860,880 A | | 1/1975 | Yariv et al. | 315/3.5 |
| 4,104,559 A | * | 8/1978 | Hobbs | 313/289 |
| 4,410,833 A | | 10/1983 | Ganguly et al. | 315/39.51 |
| 4,465,953 A | | 8/1984 | Bekefi | 315/39.71 |
| 4,742,272 A | | 5/1988 | Kusano et al. | 315/39.69 |
| 5,280,218 A | | 1/1994 | Smith | 315/39.3 |
| 5,675,210 A | | 10/1997 | Kim | 313/309 |
| 6,005,347 A | | 12/1999 | Lee | 315/39.63 |
| 6,064,154 A | | 5/2000 | Crouch et al. | 315/39.57 |

OTHER PUBLICATIONS

Partial International Search Report Re: PCT/US01/16622 mailed on Nov. 13, 2001 with Invitation to Pay Additional Fees.

* cited by examiner

*Primary Examiner*—Don Wong
*Assistant Examiner*—Thuy Vinh Tran
(74) *Attorney, Agent, or Firm*—Renner, Otto, Boisselle & Sklar

(57) ABSTRACT

An optical magnetron generator is provided which includes an anode and a collector separated by an anode-collector space, a pair of output terminals operatively coupled to the anode and the collector to provide an electrical power output based on an electric field generated across the anode-collector space. The optical magnetron generator further includes one magnet arranged to provide a dc magnetic field within the anode-collector space generally normal to the electric field, and a plurality or resonant cavities each having an opening along a surface of the anode which defines the anode-collector space; an input for receiving electromagnetic radiation from an external source and operatively configured to introduce the optical radiation into the anode-cathode space to establish a resonance electromagnetic field within the resonance cavities. A cathode for introducing electrons into the anode-collector space in proximity to the resonant electromagnetic filed, wherein the resonant electromagnetic field accelerates the electrons within the anode-collector space towards the collector onto which at least one portion of the electrons are collected.

26 Claims, 12 Drawing Sheets

OPTICAL MAGNETRON GENERATOR

TECHNICAL FIELD

The present invention relates generally to electrical generators, and more particularly to a high efficiency optical magnetron generator for converting optical radiation to electrical power.

BACKGROUND OF THE INVENTION

An optical magnetron for producing high efficiency, high power electromagnetic energy at very high frequencies is described in commonly assigned, U.S. patent application Ser. No. 09/584,887, filed on Jun. 1, 2000, which is now U.S. Pat. No. 6,373,194, and U.S. patent application Ser. No. 09/798,623, filed on Mar. 1, 2001. The present invention relates to the applicant's discovery that the optical magnetron described in the aforementioned application may operate in an inverse manner as a generator to convert optical radiation into electrical energy or power.

SUMMARY OF THE INVENTION

The present invention provides an optical magnetron generator which converts input optical radiation into electrical power. Resultantly, the generator permits the transmission of electric power without wires, for example. The generator can be used in various applications which may include the elimination of electric power transmission lines, beaming power to satellites or aircraft from ground stations, and beaming power from orbiting power stations to earth receivers thus eliminating the pollution of earth-based power stations.

According to one particular aspect of the invention, an optical magnetron generator is provided. The optical magnetron generator includes an anode and a collector separated by an anode-collector space; a pair of output terminals operatively coupled to the anode and the collector to provide an electrical power output based on an electric field generated across the anode-collector space; at least one magnet arranged to provide a dc magnetic field within the anode-collector space generally normal to the electric field; a plurality of resonance cavities each having an opening along a surface of the anode which defines the anode-collector space; an input for receiving electromagnetic radiation from an external source and operatively configured to introduce the optical radiation into the anode-cathode space to establish a resonant electromagnetic field within the resonant cavities; a cathode for introducing electrons into the anode-collector space in proximity to the resonant electromagnetic field; and wherein the resonant electromagnetic field accelerates the electrons within the anode-collector space towards the collector onto which at least a portion of the electrons are collected.

According to another aspect of the invention, an optical magnetron generator is provided which includes a cylindrical collector having a radius rc; an annular-shaped anode having a radius ra and coaxially aligned with the collector to define an anode-collector space having a width wa=ra−rc; a pair of output terminals operatively coupled to the anode and the collector to provide an electrical power output based on an electric field generated across the anode-collector space; at least one magnet arranged to provide a dc magnetic field within the anode-collector space generally normal to the electric field; and a plurality of resonant cavities each having an opening along a surface of the anode which defines the anode-collector space; an input for receiving electromagnetic radiation from an external source and operatively configured to introduce the optical radiation into the anode-cathode space to establish a resonant electromagnetic field within the resonant cavities; and a cathode for introducing electrons into the anode-collector space in proximity to the resonance electromagnetic field, wherein the electrons introduced by the cathode are influenced by the resonant electromagnetic field and the magnetic field to accelerate along a path through the anode-collector space which curves towards the collector.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF THE PREFERRED EMBODIMENTS

Figure 1:
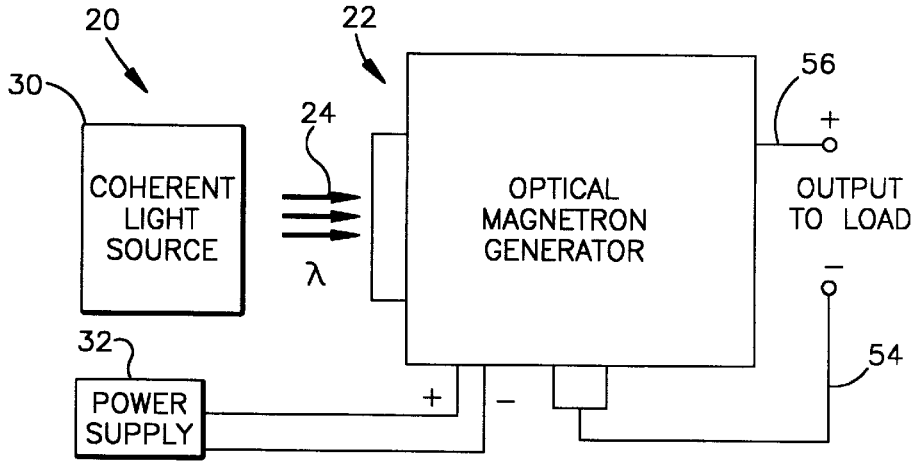
FIG. 1 is an environmental view illustrating the use of an optical magnetron generator in accordance with the present invention as part of an energy conversion system for converting optical radiation to electrical energy.

The present invention is now described in detail with reference to the drawings. Like reference numerals are used to refer to like elements throughout.

Referring initially to FIG. 1, an optical power transmission system 20 is shown. The optical power transmission system 20 includes an optical magnetron generator 22. The optical magnetron generator 22 serves to convert optical radiation to electrical energy such that power may be transmitted optically from point-to-point. Although the optical magnetron generator 22 is described herein in the context of its use in an optical power transmission system 20, it will be appreciated that the optical magnetron generator 22 has utility in a variety of other applications. The present invention contemplates any and all such applications.

As is shown in FIG. 1, the optical magnetron generator 22 receives coherent optical radiation 24 such as light in the infrared, ultraviolet or visible light region. The optical radiation 24 preferably is coherent radiation which has a wavelength corresponding to a frequency of 100 Ghz or more, although it will be appreciated that the frequency of the optical radiation 24 could be in the microwave region as low as 1 GHz without departing frm the scope of the invention. In a more particular embodiment, the optical magnetron generator 22 is designed to receive optical radiation having a wavelength in the range of about 10 microns to about 0.5 micron. According to an even more particular embodiment, the optical magnetron generator 22 receives optical radiation having a wavelength in the range of about 3.5 microns to about 1.5 microns.

The optical radiation 24 received by the optical magnetron generator 22 has a wavelength $\lambda$, referred to herein as the operating wavelength. The optical radiation 24 is provided to the optical magnetron generator 22 by a coherent light source 30, such as the optical magnetron disclosed in the aforementioned U.S. patent application Ser. Nos. 09/584,887 and 09/798,623.

The power transmission system 20 further includes a power supply 32 for providing a dc operating voltage to the optical magnetron generator 22. As will be explained in more detail below, the optical magnetron generator 22 operates on a dc voltage provided to heat the cathode in order to facilitate the emission of electrons. Of course, an ac voltage could be used to heat the cathode without departing from the scope of the invention.

Figure 2:
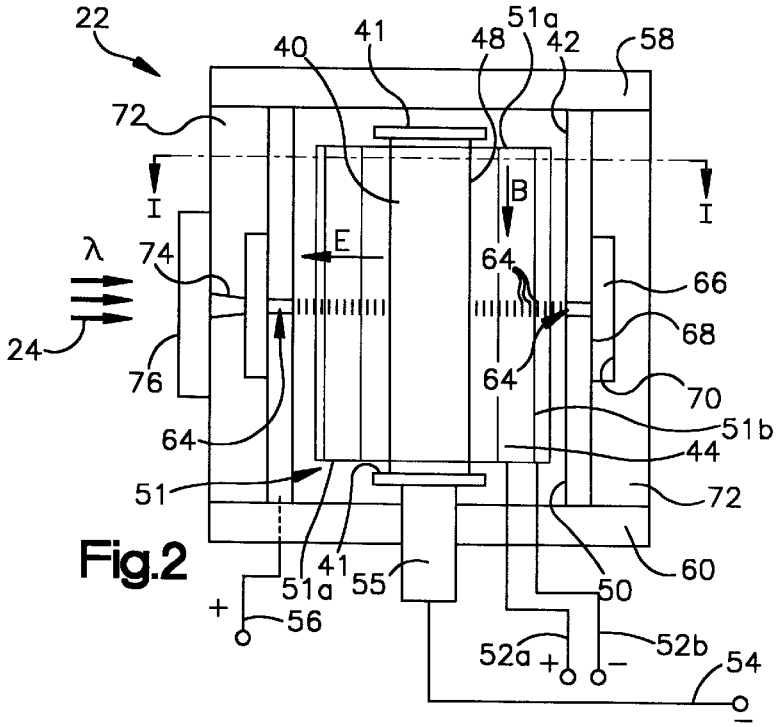
FIG. 2 is a cross-sectional view of an optical magnetron generator in accordance with one embodiment of the present invention.
Figure 3:
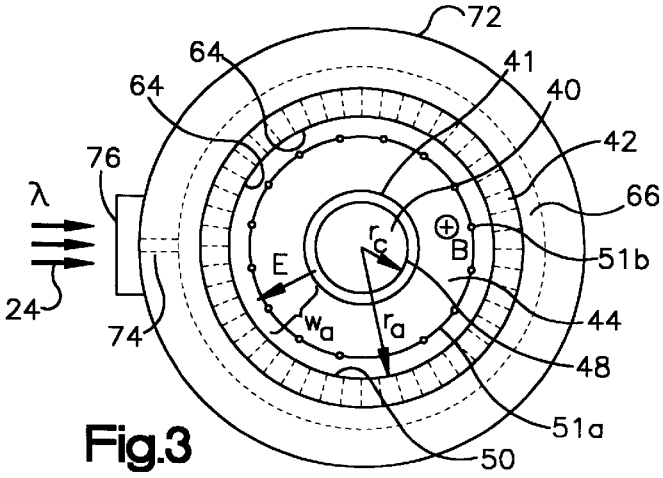
FIG. 3 is a cross-sectional top view of the optical magnetron generator of FIG. 2 taken along line I—I.

Referring now to FIGS. 2 and 3, a first embodiment of the optical magnetron 22 is shown. The generator 22 includes a cylindrically shaped collector 40 having a radius rc. Included at the respective ends of the collector 40 are endcaps 41. The collector 40 is enclosed within a hollow-cylindrical shaped anode 42 which is aligned coaxially with the collector 40. The anode 42 has an inner radius ra which is greater than rc so as to define an interaction region or anode-collector space 44 between an outer surface 48 of the collector 40 and an inner surface 50 of the anode 42.

The generator 22 further includes a cathode 51 designed to introduce electrons into the anode-collector space 44. In the exemplary embodiment, the cathode 51 has a birdcage design including a pair of end rings 51*a* separated by a plurality of legs 51*b* designed to emit electrons when heated. The cathode 51 is arranged coaxially with the anode 42 and the collector 44, with the end rings 51*a* having a radius slightly less than the inner radius ra of the anode 42. Thus, the legs 51*b* of the cathode 51 are spaced periodically around and proximate to the inner circumference of the anode 42.

The cathode 51 includes a pair of terminals 52*a* and 52*b* which are coupled to the power supply 32. During operation, current provided by the power supply 32 passes through the cathode 51, and specifically through the legs 51*b*. The resistance and composition of the legs 51*b* is selected such that the current passing therethrough causes each leg to become heated and emit free electrons. As a result, the cathode 51 introduces the emitted electrons into the anode-collector space 44. The cathode 51 may be made of any suitable material, such as those often used as filaments. For example, a fine tungsten wire arranged in a birdcage configuration may serve as the cathode 51.

The anode 42 is electrically connected to a positive (+) terminal 56 of the high voltage output. The collector 40 is electrically connected to a negative (–) terminal 54 of the high voltage output.

Continuing to refer to FIGS. 2 and 3, the generator 22 further includes a pair of magnets 58 and 60 located at the respective ends of the anode 42. The magnets 58 and 60 are configured to provide a dc magnetic field B in an axial direction which is normal to an electric field E which is established throughout the anode-collector space 44. As is shown in FIG. 3, the magnetic field B is into the page within the anode-collector space 44. The magnets 58 and 60 in the exemplary embodiment are permanent magnets which produce a magnetic field B on the order of 2 kilogauss, for example. Other means for producing a magnetic field may be used instead (e.g., an electromagnet), as will be appreciated. However, one or more permanent magnets 58 and 60 are preferred particularly in the case where it is desirable that the optical magnetron generator 22 provide some degree of portability, for example.

As will be described in more detail below in connection with FIGS. 4*a*–4*c*, for example, the inner surface 50 of the anode 42 includes a plurality of resonant cavities distributed along the circumference. In the exemplary embodiment, the resonant cavities are formed by an even number of equally spaced slots which extend in the axial direction.

The cavities are designed to resonate at the wavelength of the incoming optical radiation 24 (operating wavelength), and are spaced apart in pi-mode fashion as is described more fully below. The incoming optical radiation 24 is introduced into the anode-collector space 44 directly or via a common resonator, for example. The incoming optical radiation 24 in turn excites pi-mode resonance among the resonant cavities. The electrons which are emitted from the heated cathode 51 are introduced into the anode-cathode space 44 and in close proximity to the openings of the resonant cavities. These electrons are influenced by the pi-mode resonance created by the optical radiation 24. As a result, the electrons emitted from the heated cathode 51 are bunched together in pi-mode fashion and accelerated circumferentially by the resonance condition established by the incoming radiation 24. The electrons thus form a rotating electron cloud which rotates in close proximity to the resonant cavities.

The electrons within the electron cloud are accelerated circumferentially by the pi-mode resonance established by the optical radiation 24. As the electrons accelerate, they tend to curve radially inward as a result of the cross magnetic field B. The faster moving electrons gain sufficient energy so as to spiral inward where they are collected at the collector 40. Accordingly, a negative potential charge builds up on the collector 40 relative to the anode 42. Consequently, an electric potential E is established across the anode 42 and the collector 40. This potential can be provided to a load (not shown) via terminals 54 and 56 connected to the anode 42 and the collector 40, respectively.

As the load draws current from the generator 22 by way of the charge built up on the collector 40, additional electrons emitted by the cathode 51 are accelerated circumferentially by the pi-mode oscillations provided by the resonant cavities and the incoming radiation 24. Thus, the generator 22 constantly replenishes any electrons drawn from the collector 40 by the load.

In another embodiment, the electrons captured by the collector 40 may be used to charge a storage device (e.g., capacitor bank) (not shown) or the like from which the load ultimately draws the energy. The present invention encompasses any such variations.

As previously mentioned, the generator 22 includes a relatively large number of resonant cavities within the anode 42. These resonant cavities are preferably formed using high precision techniques such as photolithography, micromachining, electron beam lithography, reactive ion etching, etc., as will be described more fully below. The generator 22 has a relatively large anode 42 compared to the operating wavelength $\lambda$, such that the circumference of the inner anode surface 50, equal to $2\pi$ ra, is substantially larger than the operating wavelength $\lambda$.

In the exemplary embodiment of FIG. 2, every other resonant cavity includes a coupling port 64 which serves to couple energy from the respective resonant cavities to a common resonant cavity 66. The coupling ports 64 are formed by holes or slots provided through the wall of the anode 42. The resonant cavity 66 is formed around the outer circumference of the anode 42, and is defined by the outer surface 68 of the anode 42 and a cavity defining wall 70 formed within a resonant cavity structure 72. As is shown in FIGS. 2 and 3, the resonant cavity structure 72 forms a cylindrical sleeve which fits around the anode 42. The resonant cavity 66 is positioned so as to be aligned with the coupling ports 64 from the respective resonant cavities. The resonant cavity 66 serves to constrain the plurality of resonant cavities to operate in the pi-mode as is discussed more fully below in connection with FIG. 4*c*.

In addition, the cavity structure 72 may serve to provide structural support to the anode 42 which in many instances will be very thin. The cavity structure 72 also facilitates cooling the anode 42 in the event of high temperature operation.

The common resonant cavity 66 includes at least one or more input ports 74 which serve to couple coherent optical radiation 24 at the operating wavelength $\lambda$ into the resonant cavity 66 via a corresponding transparent input window 76. The input port(s) 74 are formed by holes or slots provided through the wall of the resonant cavity structure 72. The input window(s) 76 preferably are each formed by a partially transmissive mirror designed to allow the optical radiation 24 to pass through freely; whereas the radiation from within the anode-collector space 44 tends to be electrically reflected by the input window 76.

The structure shown in FIGS. 2 and 3, together with the other embodiments described herein, is preferably constructed such that the anode-collector space 44 and resonant cavity 66 are maintained within a vacuum. This prevents dust or debris from entering into the device and otherwise disturbing the operation thereof.

Figure 4A:
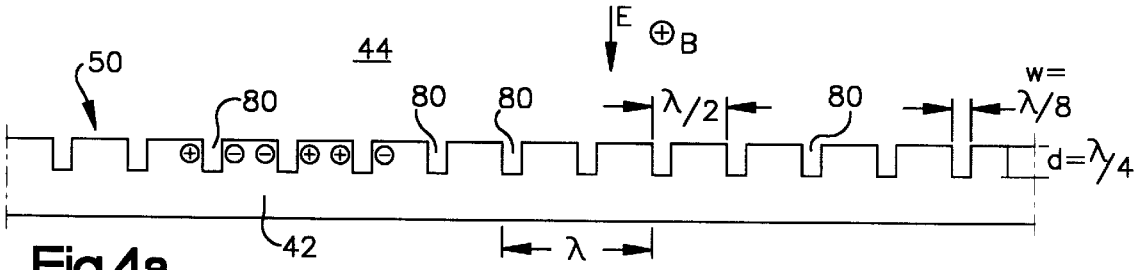
FIGS. 4*a*, 4*b* and 4*c* are enlarged cross-sectional views of a portion of the anode in accordance with the present invention, each anode including resonant cavities according to one embodiment of the present invention.

FIG. 4*a* represents a cross-sectional view of a portion of the anode 42 according to a general embodiment. The cross-section is taken in a plane which is perpendicular to the common axis of the anode 42 and cathode 40 as will be appreciated. The curvature of the anode 42 has not been shown for ease of illustration. As is shown, each resonant cavity within the anode 42 is represented by a slot 80 formed at the surface 50 of the anode 42. In the exemplary embodiment, the slots 80 have a depth d equal to $\lambda/4$ to allow for resonance, where $\lambda$ represents the wavelength of the input optical radiation 24 at the desired operating frequency. The slots 80 are spaced apart a distance of $\lambda/2$ or less, and each slot has a width w equal to $\lambda/8$ or less. The slot width w should be $\lambda/8$ or less to allow electrons to pass the slot 80 before the electric field reverses in pi-mode operation as can be shown.

The total number N of slots 80 in the anode 42 is selected such that the electrons moving through the anode-collector space 44 preferably are moving substantially slower than the speed of light c (e.g., approximately on the order of 0.1 c to 0.3 c). The slots 80 are evenly spaced around the inner circumference of the anode 42, and the total number N is selected so as to be an even number in order to permit pi-mode operation. The slots 80 have a length which may be somewhat arbitrary, but preferably is similar in length to the cathode 40. For ease of description, the N slots 80 may be considered as being numbered in sequence from 1 to N about the circumference of the anode 42.

Figure 4B:
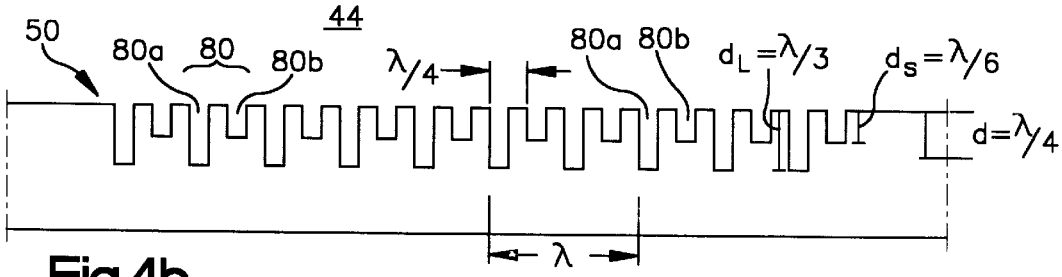

FIG. 4*b* represents a particular embodiment of the anode 42 designed to encourage pi-mode oscillation at the desired operating frequency. The aforementioned slots 80 are actually comprised of long slots 80*a* and short slots 80*b*. The long slots 80*a* and short slots 80*b* are arranged at intervals of $\lambda/4$ in alternating fashion as shown in FIG. 4*b*. The long slots 80*a* and short slots 80*b* have a depth ratio of 2:1 and an average depth of $\lambda/4$ in the preferred embodiment. Consequently, the long slots 80*a* have a depth dI equal to $\lambda/3$ and the short slots 80*b* have a depth ds equal to $\lambda/6$. Such arrangement of long and short slots is known in the microwave bands as a "rising sun" configuration. Such configuration promotes pi-mode oscillation with the long slots 80*a* lagging in phase and the short slots 80*b* leading in phase.

Although not shown in FIGS. 4*a* and 4*b*, one or more of the resonant cavities formed by the respective slots 80 will include one or more coupling ports 64 which couple energy from within the common resonant cavity 66 as represented in FIGS. 2 and 3, for example, into the respective slots 80 and the anode-cathode space 44 therein. Alternatively, the coupling port(s) 64 serve to couple energy from the input window 76 directly into one or more of the respective slots 80 and the anode-cathode space 44 therein, as discussed below in connection with the embodiment of FIGS. 9 and 10, for example. The coupling ports 64 preferably are provided with respect to slots 80 which are in phase with each other so as to add constructively. Alternatively, one or more phase shifters may be used to adjust the phase of radiation from the coupling ports 64 so as to all be in phase.

Figure 4C:
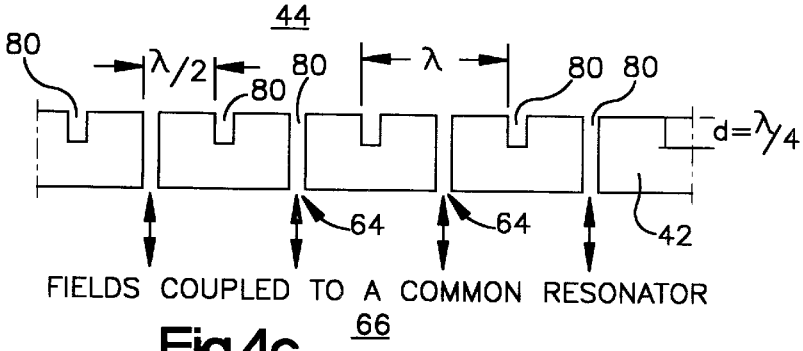

FIG. 4*c* represents another particular embodiment of the anode 42 designed to encourage pi-mode oscillation at the desired operating frequency. Such embodiment of the anode 42 is specifically represented in the embodiment of FIGS. 2 and 3. An external stabilizing resonator in the form of the common resonant cavity 66 serves to encourage pi-mode oscillation in accordance with the invention. Specifically, every other slot 80 (i.e., either every even-numbered slot or every odd-numbered slot) is coupled to the resonant cavity 66 via a respective coupling port 64 so as to all be in phase. The slots 80 are spaced at intervals of $\lambda/2$ and otherwise each has a depth d equal to $\lambda/4$.

As will be appreciated, the slots 80 in each of the embodiments described herein represent micro resonators. The following table provides exemplary dimensions, etc. for an optical magnetron generator 22 in accordance with the present invention. In the case of a practical sized device in which the collector 40 has a radius rc of 2 millimeters (mm) and the anode 42 has an inner radius ra of 7 mm, a length of 1 centimeter (cm), a magnetic field B of 2 kilogauss, and an electric field E potential of 30 kV to 50 kV, the dimensions relating to the slots 80 in the case of the configuration of FIG. 4*c* may be as follows, for example:

TABLE

| Operating Wavelength $\lambda$ (mm) | Number of Slots N | Slot Width w (microns) | Slot Depth d (microns) |
|---|---|---|---|
| $10^{-2}$ | 87,964 | 1.25 | 2.5 |
| $3.5 \times 10^{-3}$ | 251,324 | 0.4375 | 0.875 |
| $1.5 \times 10^{-3}$ | 586,424 | 0.1875 | 0.375 |
| $0.5 \times 10^{-3}$ | 1,759,274 | 0.0625 | 0.125 |

The output power for such an optical magnetron generator 22 will be on the order of 1 kilowatt (kW) continuous. In addition, efficiencies will be on the order of 85%. Consequently, the generator 22 of the present invention is well suited for any application which utilizes a high efficiency, high power conversion of optical radiation to electrical power.

The micro resonators or resonant cavities formed by the slots 80 can be manufactured using a variety of different techniques available from the semiconductor manufacturing industry. For example, existing micromachining techniques are suitable for forming slots having a width of 2.5 microns or so. Although specific manufacturing techniques are described below, it will be generally appreciated that an electrically conductive hollow cylinder anode body may be controllably etched via a laser beam to produce slots 80 having the desired width and depth. Alternatively, photolithographic techniques may be used in which the anode 42 is formed by a succession of electrically conductive layers stacked upon one another with teeth representing the slots 80. For higher frequency applications (e.g., $\lambda=0.5\times10^{-4}$ mm), electron beam (e-beam) techniques used in semiconductor processing may be used to form the slots 80 within the anode 42. In its broadest sense, however, the present invention is not limited to any particular method of manufacture.

Figure 5:
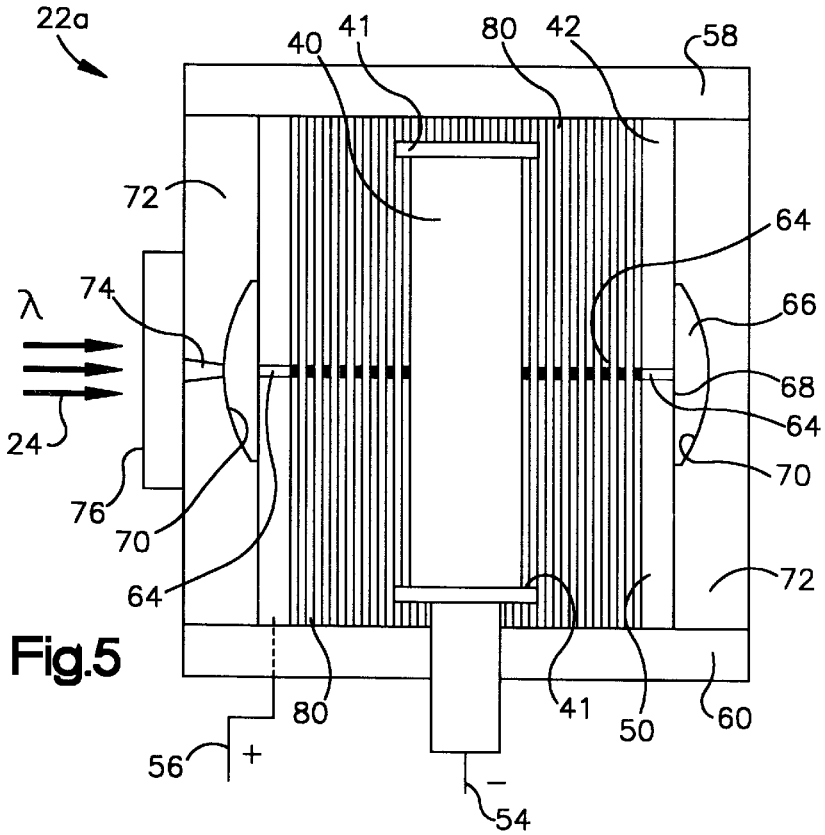
FIG. 5 is a cross-sectional view of an optical magnetron generator in accordance with another embodiment of the present invention.

Referring now to FIG. 5, another embodiment of the optical magnetron generator in accordance with the present invention is generally designated 22*a*. The cathode 51 is not shown in FIG. 5 so as to facilitate viewing. Such embodiment is virtually identical to the embodiment of FIGS. 2 and 3 with the following exception. The common resonant cavity 66 in this embodiment has a curved outer wall 70 so as to form a toroidal shaped resonant cavity 66. The radius of curvature of the outer wall 70 is on the order of 2.0 cm to 2.0 m, depending on the operating frequency. The toroidal shaped resonant cavity 66 serves to improve the ability of the common resonant cavity 66 to control the pi-mode oscillations at the desired operating frequency.

It is noted that each of the coupling ports 64 from the even numbered slots 80, for example, are aligned horizontally at the center of the anode 42 with the vertex of the curved outer wall 70. This tends to focus the resonant optical radiation towards the center of the anode 42 and reduce light leakage from the ends of the cylindrical anode 42. The odd numbered slots 80 do not include such coupling ports 64 and consequently are driven to oscillate out of phase with the even numbered slots 80.

Figure 6:
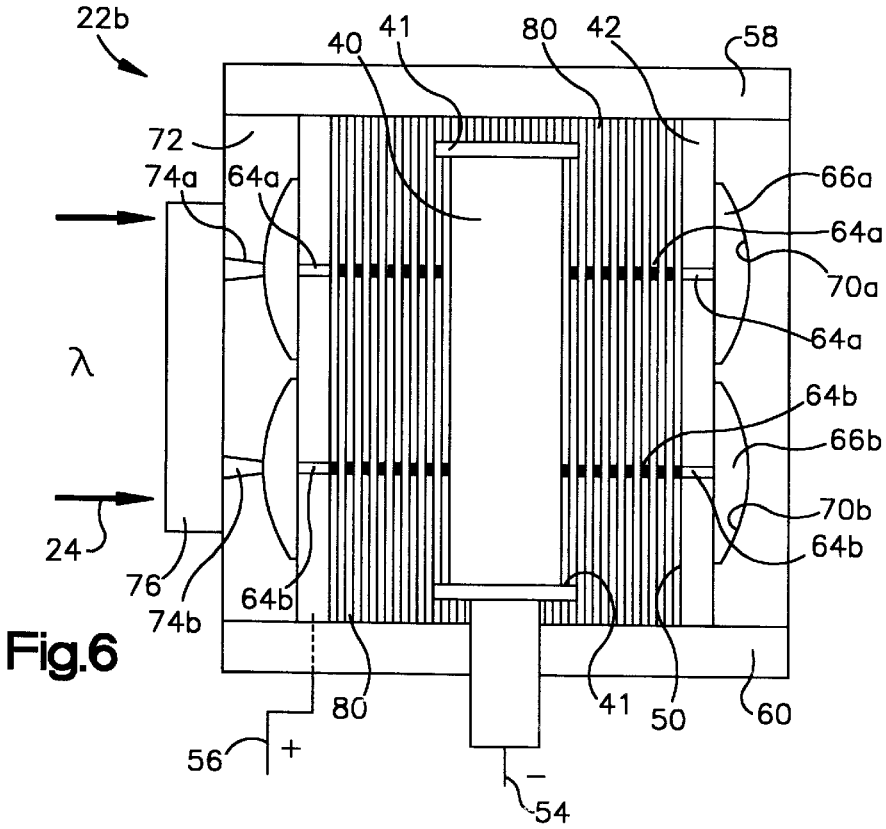
FIG. 6 is a cross-sectional view of an optical magnetron generator in accordance with yet another embodiment of the present invention.

FIG. 6 illustrates another embodiment of the optical magnetron generator which is generally designated 22*b*. Again, the cathode 51 has been omitted from the figure to facilitate viewing. The embodiment of FIG. 6 is virtually identical to that of FIG. 5 with the following exceptions. In this particular embodiment, the magnetron generator 22*b* comprises a double toroidal common resonator. More specifically, the magnetron generator 22*b* includes a first toroidal shaped resonant cavity 66*a* and a second toroidal shaped resonant cavity 66*b* formed in the resonant cavity structure 72. Each of the even-numbered slots 80 among the N total slots 80 is coupled by a coupling port 64*a* to the first cavity 66*a*. Each of the odd-numbered slots 80 among the N total slots 80 is coupled to the second cavity 66*b* by way of a coupling port 64*b*.

The first resonant cavity 66*a* is a higher frequency resonator designed to lock a resonant mode at a frequency which is slightly higher than the desired operating frequency. The second resonant cavity 66*b* is a lower frequency resonator designed to lock a resonant mode at a frequency which is slightly lower than the desired frequency, such that the entire device oscillates at an intermediate average frequency corresponding to the desired operating frequency. The higher frequency modes within the first resonant cavity 66*a* will tend to lead in phase while the low frequency modes in the second resonant cavity 66*b* lag in phase about the desired operation frequency. Consequently, pi-mode operation will result.

Input radiation 24 may be provided from one or both of the input port(s) 74*a* and 74*b*. As in the previous embodiment, the radii of curvature for the outer walls 70*a* and 70*b* of the cavities 66*a* and 66*b*, respectively, are on the order of 2.0 cm to 2.0 m. However, the radii of curvature are designed slightly shorter and longer for the walls 70*a* and 70*b*, respectively, in order to provide the desired high/low frequency operation with respect to the desired operating frequency.

In a different embodiment, more than two resonant cavities 66 may be formed around the anode 42 for constraining operation to the pi-mode. The present invention is not necessarily limited to a particular number. Furthermore, the cavities 66*a* and 66*b* in the embodiment of FIG. 6 may instead be designed to both operate at the desired operating frequency rather than offset as previously described and as will be appreciated.

Figure 7A:
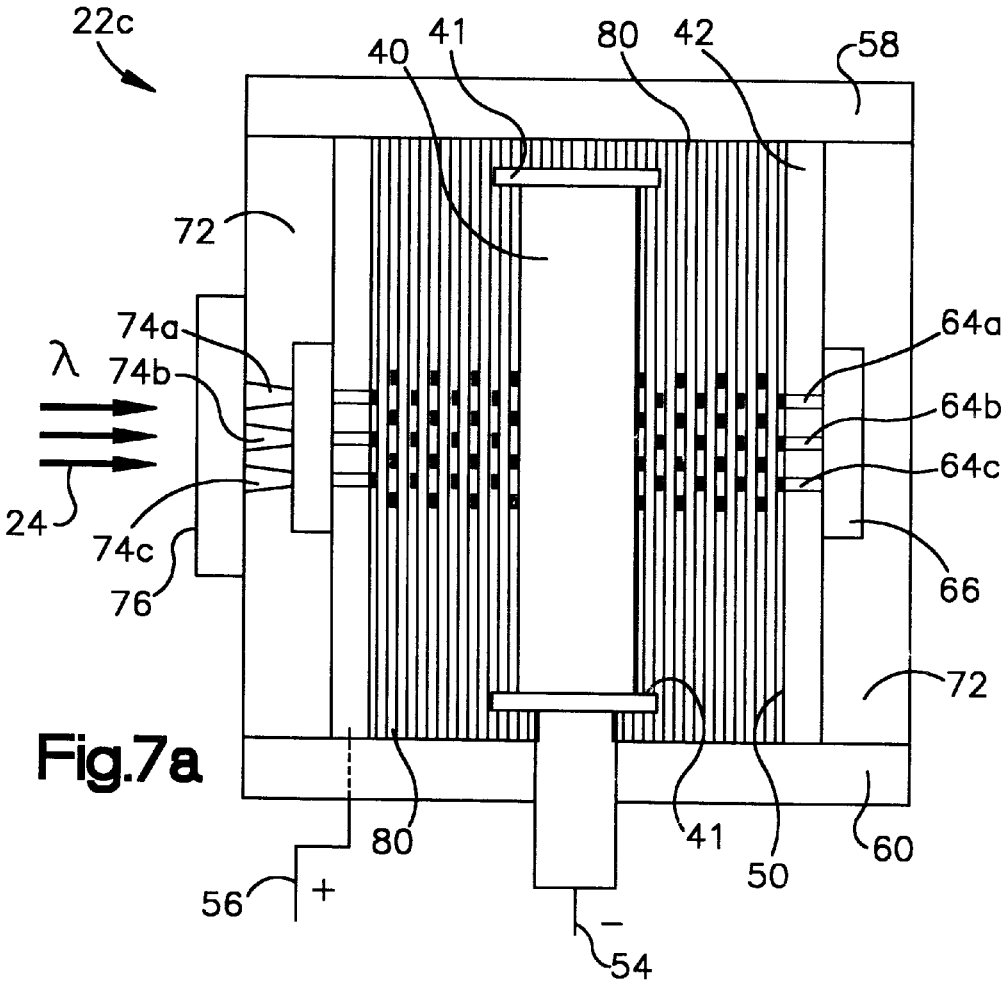
FIG. 7*a* is a cross-sectional view of an optical magnetron generator in accordance with still another embodiment of the present invention.
Figure 7B:
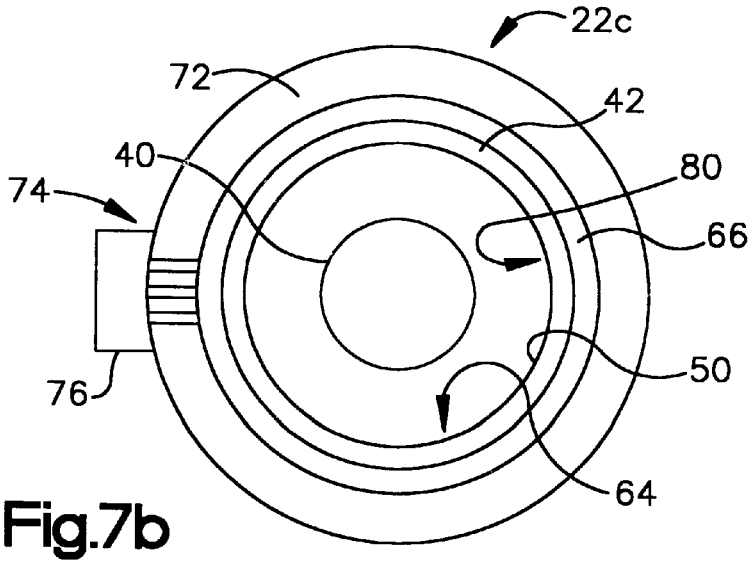
FIG. 7*b* is a cross-sectional top view of the optical magnetron generator of FIG. 7*a;*

Turning now to FIGS. 7*a* and 7*b*, still another embodiment of an optical magnetron generator is shown, this time designated as 22*c*. As with all of the remaining embodiments, the cathode 51 is omitted for better viewing. This embodiment illustrates how every other slot 80 (i.e., all the even numbered slots or all the odd numbered slots) may include more than one coupling port 64 to couple energy between the respective resonant cavity and the common resonant cavity 66. For example, FIG. 7*a* illustrates how even numbered slots 80 formed in the anode 42 alternate having three and four coupling ports 64 in the respective slots 80. As in the other embodiments, the coupling ports 64 couple energy to/from the common resonant cavity 66 in order to better control the oscillation modes and induce pi-mode operation. As is also shown in FIGS. 7*a* and 7*b*, the optical magnetron generator 22*c* may include multiple input ports 74*a*, 74*b*, 74*c*, etc. for coupling the coherent optical input radiation 24 from the input window 76 into the resonant cavity 66. By forming an array of input ports 74 and/or coupling ports 64 as described herein, it is possible to control the amount of coupling which occurs as will be appreciated.

Although not shown in FIG. 7*a*, it will be appreciated that the common resonant cavity 66 could be replaced with a toroidal shaped cavity as in the embodiment of FIG. 5, for example. Moreover, it will be readily appreciated that an optical magnetron generator 22 in accordance with the invention may be constructed by any combination of the various features and embodiments described herein, namely (i) an anode structure comprising a plurality of small resonant cavities 80 which may be scaled according to the desired operating wavelength to sizes as small as optical wavelengths; (ii) a structure for constraining the resonant cavities 80 to operate in the so-called pi-mode whereby each resonant cavity 80 is constrained to oscillate pi-radians out of phase with its nearest neighbors; and (iii) means for coupling the optical input radiation 24 to the resonant cavities to induce conversion to electrical output power. Different slot 80 configurations are discussed herein, as are different forms of one or more common resonant cavities for constraining the resonant cavities. In addition, the description herein provides means for coupling power from the resonant cavities via the various forms and arrangements of coupling ports 64 and input ports 74. On the other hand, the present invention is not intended to be limited in its broadest sense to the particular configurations described herein.

Figure 8:
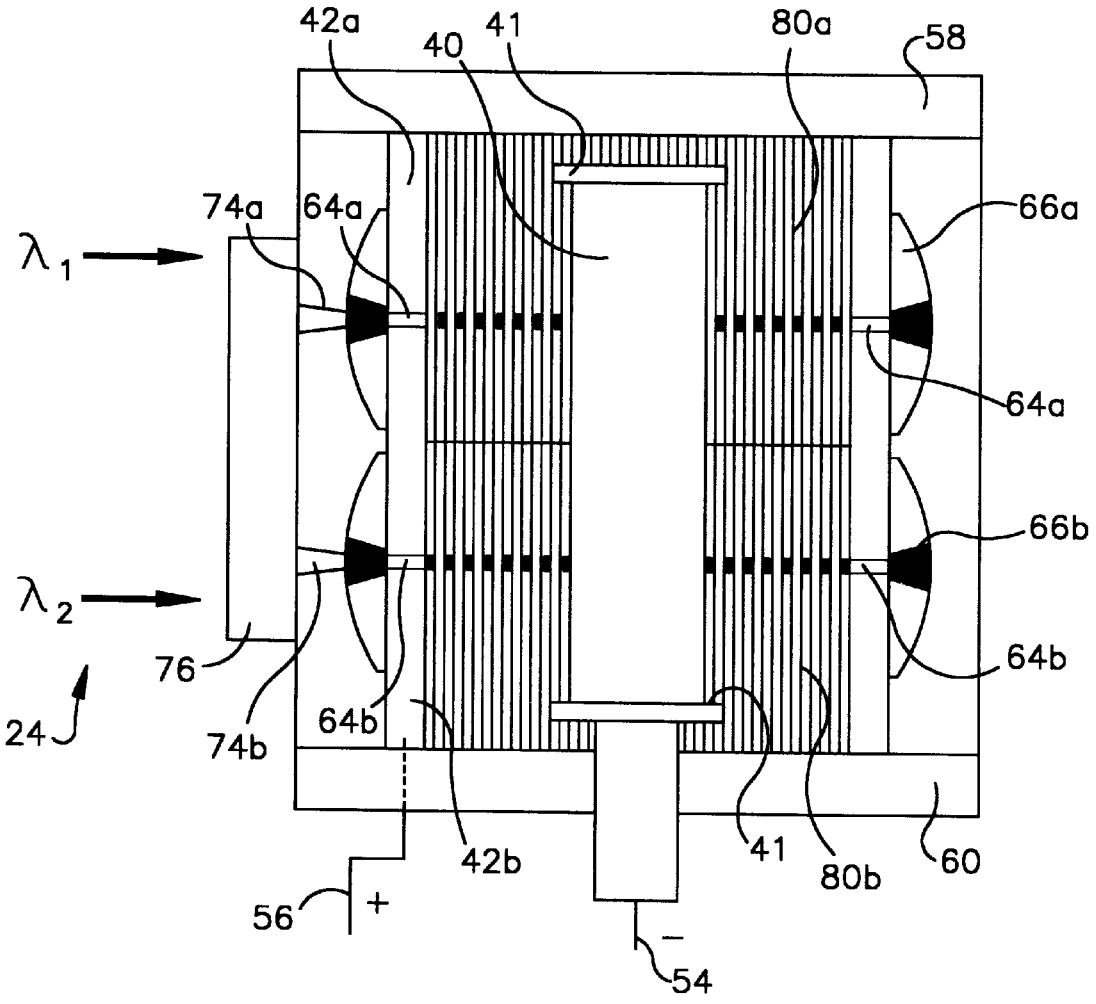
FIG. 8 is a cross-sectional view of an optical magnetron generator in accordance with a multi-wavelength embodiment of the present invention.

Referring briefly to FIG. 8, a vertically stacked multifrequency embodiment of the present invention is shown. In this embodiment, the anode 42 is divided into an upper anode 42*a* and a lower anode 42*b*. In the upper anode 42*a*, the slots 80*a* are designed with a width, spacing and number corresponding to a first operating wavelength $\lambda_1$. The slots 80*b* in the lower anode 42*b*, on the other hand, are designed with a width, spacing and number corresponding to a second operating wavelength $\lambda_2$ different from the first operating wavelength $\lambda_1$.

Even-numbered slots 80*a*, for example, in the upper anode 42*a* include coupling ports 64*a* which couple energy between a rotating electron cloud formed in the upper anode 42*a* and an upper common resonant cavity 66*a*. Likewise, even-numbered (or odd numbered) slots 80*b* in the lower anode 42*b* include coupling ports 64*b* which couple energy between a rotating electron cloud formed in the lower anode 42*b* and a lower common resonant cavity 66*b*. The upper and lower common resonant cavities 66*a* and 66*b* serve to promote pi-mode oscillation at the respective frequencies at wavelengths $\lambda_1$ and $\lambda_2$ in the upper and lower anodes 42*a* and 42*b*. Coherent optical input radiation 24 at the respective frequencies having wavelengths $\lambda_1$ and $\lambda_2$ is input respectively into the common resonant cavities 66*a* and 66*b* through the input window 76 via one or more input ports 74*a* and 74*b*, respectively.

Thus, the present invention as represented in FIG. 8 provides a manner for vertically stacking two or more anode resonators each having a different operating wavelength (e.g., $\lambda_1$ and $\lambda_2$). The anodes (e.g., upper and lower anodes 42*a* and 42*b*) may be stacked vertically between a single pair of magnets 58 and 60. The stacked device may therefore convert multiple frequencies into electrical power.

Figure 9:
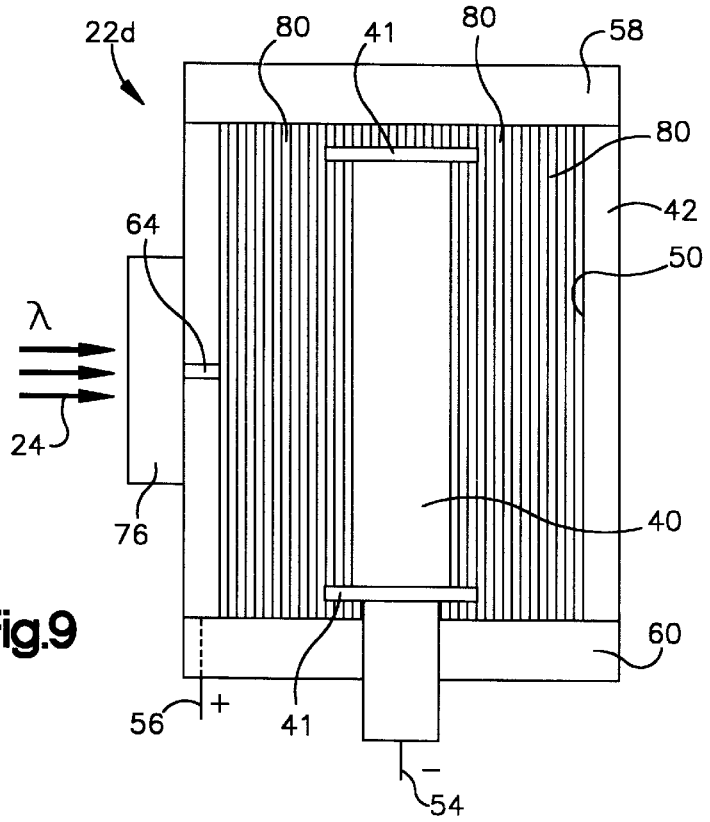
FIG. 9 is a cross-sectional view of an optical magnetron generator according to another embodiment of the present invention.
Figure 10:
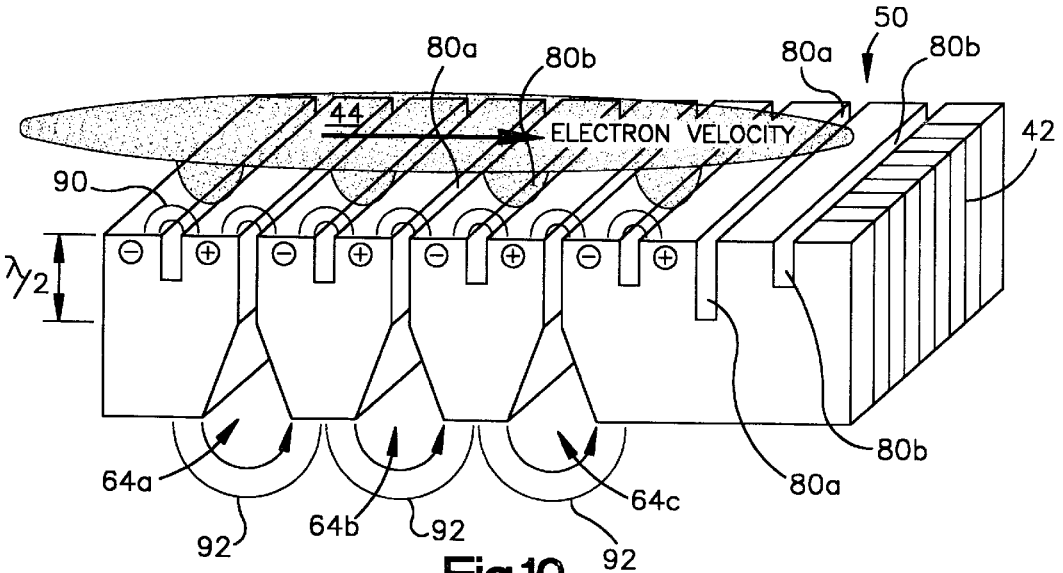
FIG. 10 is an enlarged perspective view of a portion of the anode showing the input coupling.

FIGS. 9 and 10 illustrate an embodiment of the invention which provides direct coupling of the input radiation 24 into the anode-collector space 44 via the input window 76 and the coupling ports 64. FIG. 10 illustrates how the rotating electron cloud within the anode-collector space 44 creates fringing fields 90 at the opening of the slots 80 and the coupling ports 64 therein as the cloud passes by. The fringing fields 90 at the openings of the coupling ports are emitted from the opposite side of the anode 42 as radiation fields 92. In turn, the radiation fields 92 interact constructively with the input radiation 24 introduced via the input window 76 so as to result in pi-mode bunching.

In the other embodiments described herein, the input radiation 24 is first introduced into a common resonant cavity 66. The common resonant cavity 66 provides improved control of the pi-mode operation as previously discussed. Nevertheless, the present invention contemplates an embodiment which is perhaps less efficient but also useful in which the coupling ports 64 couple the input radiation 24 from the input window 76 directly into the anode-collector space 44. In such case, as is shown in FIG. 9, there is no need for coupling ports 64 in the slots 80 other than those which couple the input radiation 24 from the input window 76. The coupling principles of FIG. 10, however, apply to all of the coupling ports 64 and input ports 74 discussed herein as will be appreciated.

Figure 11A:
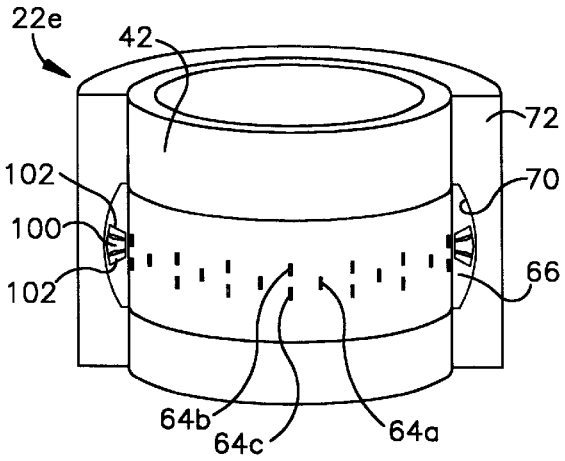
FIGS. 11*a*, 11*b* and 11*c* schematically represent an embodiment of the present invention designed to operate in the $TEM_{20}$ mode.
Figure 11B:
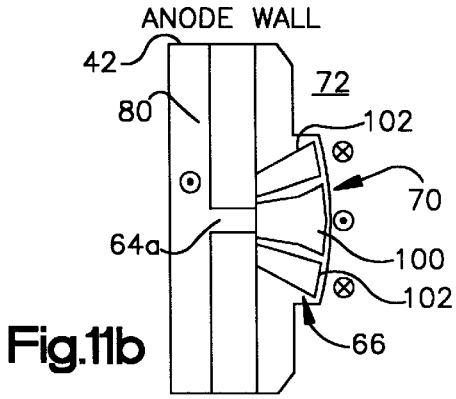
Figure 11C:
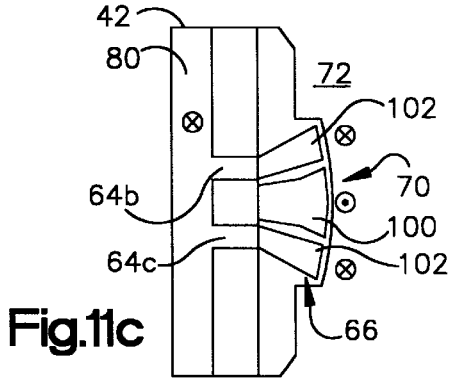

FIGS. 11*a*–11*c* illustrate an embodiment of an optical magnetron generator 22*e* designed for operation in the $TEM_{20}$ mode in accordance with the present invention. The embodiment is similar to that described above in connection with FIG. 5 in that it includes a toroidal shaped resonant cavity 66 with a curved outer wall 70. The embodiment differs from that of FIG. 5 in that even numbered slots 80 have a single coupling port 64*a* which is aligned with vertex of the curved outer wall 70 as is shown in FIG. 11*b*. Consequently, the even numbered slots 80 tend to excite the central spot 100 of the resonant cavity 66.

On the other hand, the odd numbered slots 80 include two coupling ports 64*b* and 64*c* offset vertically on opposite sides of the vertex of the curved outer wall 70 as is shown in FIG. 11*c*. Consequently, the odd numbered slots 80 will tend to excite outer spots 102 of the resonant cavity 66. The result is a $TEM_{20}$ single mode within the toroidal shaped resonant cavity 66. The central spot 100 has an electric field direction (e.g., out of the page in FIGS. 11*b* and 11*c*) which is opposite the electric field direction (e.g., into the page) of the outer spots 102. The electric fields change direction each half-cycle of the oscillation. The even-numbered slots 80 will thus have their electric fields driven out-of-phase with respect to the odd-numbered slots 80, and the slots 80 are forced to operate in the desired pi-mode.

Figure 11D:
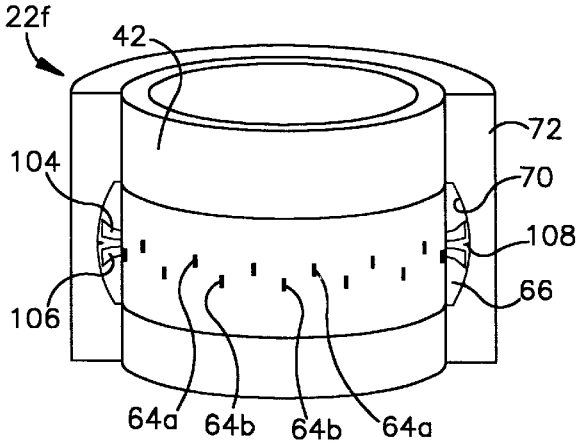
FIGS. 11*d*, 11*e* and 11*f* schematically represent an embodiment of the present invention designed to operate in the $TEM_{10}$ mode.
Figure 11E:
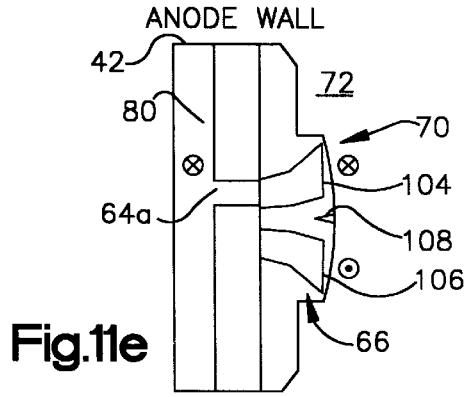
Figure 11F:
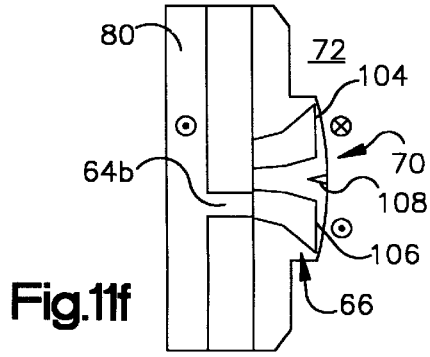

FIGS. 11*d*–11*f* represent an embodiment of an optical magnetron generator 22*f* which, in this case, is designed for operation in the $TEM_{10}$ mode according to the present invention. Again, the embodiment is similar to that described above in connection with FIG. 5 in that it includes a toroidal shaped resonant cavity 66 with a curved outer wall 70. This embodiment differs from that of FIG. 5 in that even numbered slots 80 have a coupling port 64*a* which is offset above the vertex of the curved outer wall 70 as shown in FIG. 11*e*. As a result, the even numbered slots 80 tend to excite an upper spot 104 of the resonant cavity 66.

The odd numbered slots 80, conversely, include a coupling port 64*b* which is offset below the vertex of the curved outer wall 70 as is shown in FIG. 11*f*. As a result, the odd numbered slots 80 tend to excite a lower spot 106 of the resonant cavity 66. In this case, the result is a $TEM_{10}$ single mode within the toroidal shaped resonant cavity 66. The upper spot 104 has an electric field direction (e.g., into the page in FIGS. 11*e* and 11*f*) which is opposite the electric field direction (e.g., out of the page) of the lower spot 106. A small protrusion 108, or "spoiler" may be provided around the circumference of the resonant cavity 66 at the vertex of the curved outer wall 70 to help suppress the $TEM_{00}$ mode. The respective electric fields of the upper and lower spots change direction each half-cycle of the oscillation. The even numbered slots 80 thus have their electric fields driven out-of-phase with respect to the odd numbered slots 80, and the slots 80 are forced to operate in the desired pi-mode.

FIGS. 11*a*–11*f* present two possible single modes in accordance with the present invention. It will be appreciated, however, that other TEM modes may also be used for pi-mode control without departing from the scope of the invention.

As far as manufacture, the collector 40 of the magnetron generator 22 may be formed of any of a variety of electrically conductive metals as will be appreciated. The collector 40 may be solid or simply plated with an electrically conductive metal such as copper, gold or silver, or may be fabricated from a spiral wound thoriated tungsten filament, for example.

The anode 42 is made of an electrically conductive metal and/or of a non-conductive material plated with a conductive layer such as copper, gold or silver. The resonant cavity structure 72 may or may not be electrically conductive, with the exception of the walls of the resonant cavity or cavities 66 and output ports 74 which are either plated or formed with an electrically conductive material such as copper, gold or silver. The anode 42 and resonant cavity structure 72 may be formed separately or as a single integral piece as will be appreciated.

Figure 12A:
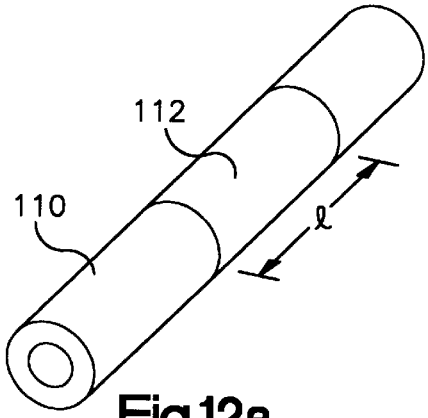
FIGS. 12*a* and 12*b* represent steps used in forming an anode structure in accordance with one embodiment of the present invention.
Figure 12B:
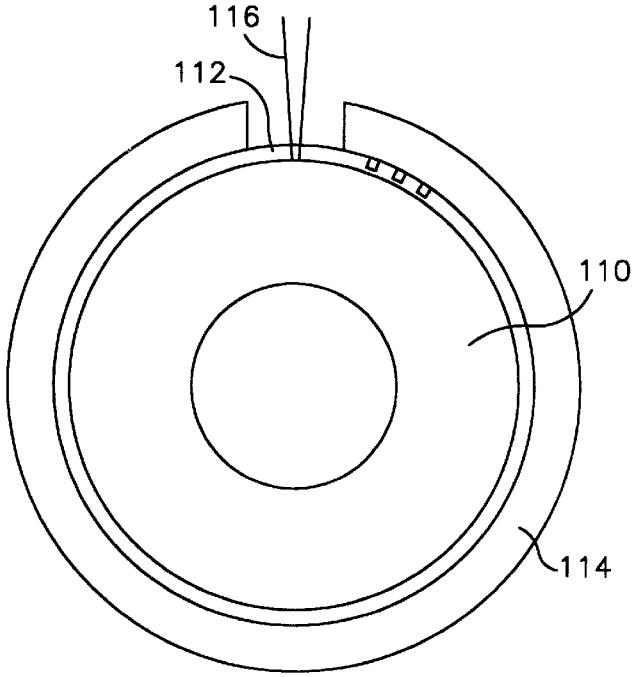

FIGS. 12*a* and 12*b* illustrate an exemplary manner for producing an anode 42 using an electron beam lithography approach. A cylindrical hollow aluminum rod 110 is selected having a radius equal to the desired inner radius $r_a$ of the anode 42. A layer 112 of positive photoresist, for example, is formed about the circumference of the rod 110 as is shown in FIG. 12*a*. The length I of the resist layer 112 along the axis of the rod 110 should be made on the order of the desired length of the anode 42 (e.g., 1 centimeter (cm) to 2 cm). The thickness of the of the resist layer 112 is controlled so as to equal the desired depth of the resonant cavities or slots 80.

The rod 110 is then placed in a jig 114 within an electron beam patterning apparatus used for manufacturing semiconductors, for example, as is represented in FIG. 12*b*. An electron beam 116 is then controlled so as to pattern by exposure individual lines along the length of the of the resist layer 112 parallel with the axis of the rod 110. As will be appreciated, these lines will serve to form the sides of the resonant cavities or slots 80 in the anode 42. The lines are controlled so as to have a width equal to the spacing between adjacent slots 80 (e.g., the quantity $\lambda/2$–$\lambda/8$ in the case of the embodiments such as FIG. 4*a* and FIG. 4*c*). The lines are spaced apart from each other by the desired width w of the slots 80 (e.g., $\lambda/8$ in the case of embodiments such as FIG. 4*a* and FIG. 4*c*). The patterned resist layer 112 is then developed and etched such that the exposed portion of the resist layer 112 is removed. This results in the rod 110 having several small fins or vanes, formed from resist, respectively corresponding to the slots 80 which are to be formed in the anode 42. The rod 110 and the corresponding fins or vanes are then copper electroplated to a thickness corresponding to the desired outer diameter of the anode 42 (e.g., 2 mm). As will be appreciated, the copper plating will form around the fins or vanes until the plating ultimately covers the rod 110 substantially uniformly.

The aluminum rod 110 and fins or vanes made of resist are then removed from the copper plating by chemically dissolving the aluminum and resist with any available solvent known to be selective between aluminum/resist and copper. Similar to the technique known as lost wax casting, the remaining copper plating forms an anode 42 with the desired resonant cavities or slots 80.

It will be appreciated that the equivalent structure may be formed via the same techniques except with a negative photoresist and forming an inverse pattern for the slots, etc.

Slots 80 having different depths, such as in the embodiment of FIG. 4*b*, may be formed using the same technique but with multiple layers of resist. A first layer of resist 112 is patterned and etched to form the fins or vanes on the aluminum rod 110 corresponding to both the long slots 80*a* and the short slots 80*b* (FIG. 4*b*). The first layer of resist 112 has a thickness ds corresponding to the depth of the short slots. A second and subsequent layer of resist 112 is formed on the first patterned layer. The second layer 112 is patterned to form the remaining portion of the fins or vanes which will be used to form the long slots 80. In other words, the second layer 112 has a thickness of dl–ds. The various coupling ports 64 may be formed in the same manner, that is with additional layers of resist 112 in order to define the coupling ports 64 at the desired locations. The rod 110 and resist is then copper plated, for example, to form the anode 42 with the rod 110 and resist subsequently being dissolved away. The same technique for forming the coupling ports 64 may be applied to the above-described manufacturing technique for the embodiment of FIG. 4*c*, as will be appreciated.

Figure 13:
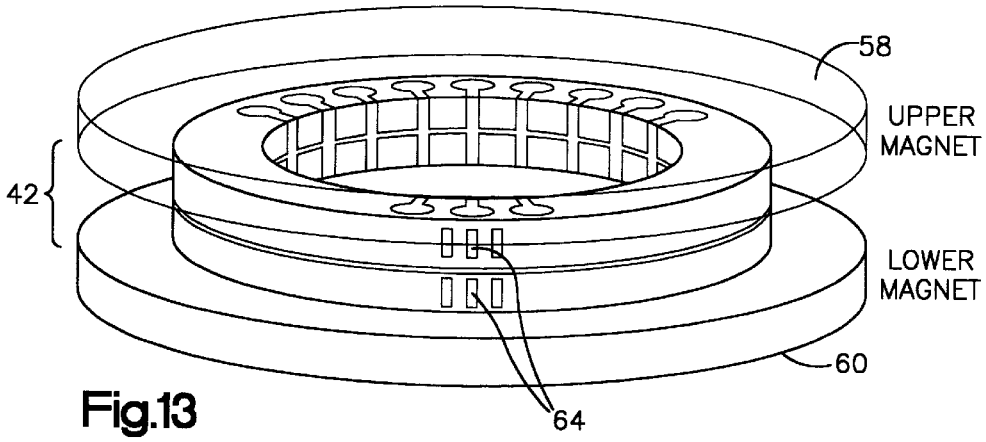
FIG. 13 represents another method for forming an anode structure in accordance with the present invention.

FIG. 13 illustrates the manner in which the anode 42 may be formed as a vertical stack of layers using known micromachining/photolithography techniques. A first layer of metal such as copper is formed on a substrate. A layer of photoresist is then formed on the copper and thereafter the copper is patterned and etched (e.g., via electron beam) so as to define the resonant cavities or slots 80 in a plane normal to the axis of the anode 42. Subsequent layers of copper are then formed and etched atop the original layers in order to create a stack which is subsequently the desired length of the anode 42. As will be appreciated, planarization layers of oxide or some other material may be formed in between copper layers and subsequently removed in order to avoid filling an existing slot 80 when depositing a subsequent layer of copper, for example. Also, such oxide may be used to define coupling ports 64 as desired, such oxide subsequently being removed by a selective oxide/copper etch.

As will be appreciated, known photolithography and micromachining techniques used in the production of semiconductor devices may be used to obtain the desired resolution for the anode 42 and corresponding resonant cavities (e.g., slots 80). The present invention nevertheless is not intended to be limited, in its broadest sense, to the particular methods described herein.

Figure 14A:
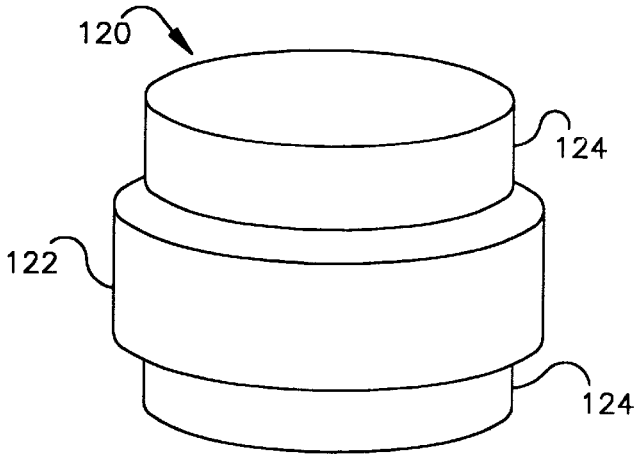
FIGS. 14*a*–14*c* represent steps used in forming a toroidal optical resonator in accordance with the present invention.
Figure 14C:
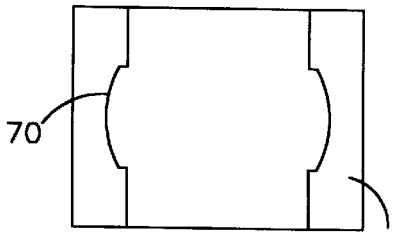
Figure 14B:
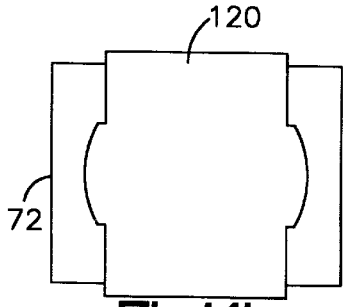

FIGS. 14*a*–14*c* illustrate a technique for forming the resonant cavity structure 72 with a toroidal shape as described herein. For example, an aluminum rod 120 is machined so as to have bump 122 in the middle as shown in FIG. 14*a*. The radius of the rod 120 in upper and lower portions 124 is set equal to approximately the outer radius of the anode 42 around which the structure 72 will fit. The bump 122 is machined so as to have a radius corresponding to the vertex point of the structure 72 to be formed.

Thereafter, the bump 122 is rounded to define the curved toroidal shape of the wall 70 as described above. Next, the thus machined rod 112 is electroplated with copper to form the structure 72 therearound as represented in FIG. 14*b*. The aluminum rod 120 is then chemically dissolved away from the copper structure 72 so as to result in the structure 72 as shown in FIG. 14*c*. Output ports 74 may be formed as needed using micromachining (e.g., via laser milling), for example.

Reference is now made to FIGS. 15–38 which relate to a variety of different anode structures 42 suitable for use in alternative embodiments of an optical magnetron generator in accordance with the present invention. As will be appreciated, the anodes 42 as shown in FIGS. 15–38 can be substituted for the anode 42 in the other embodiments previously discussed herein, for example the embodiments of FIGS. 5–9. Again, each of the anodes 42 has a generally hollow-cylindrical shape with an inner surface 50 defining the anode-collector space 44 into which the cathode 51 and collector 40 (not shown) are coaxially placed. Depending on the particular embodiment, one or more common resonant cavities 66 (not shown) are formed around the outer circumference of the anode 42 via a resonant cavity structure 72 (also not shown) as in the previous embodiments. Since only the structure of the anode 42 itself differs in relevant part with respect to the various embodiments discussed herein, the following discussion is limited to the anode 42 for sake of brevity. It will be appreciated by those skilled in the art that the present invention contemplates an optical magnetron generator as previously discussed herein incorporating any and all of the different anode structures 42. Moreover, it will be appreciated that the anode structures 42 may have utility as part of a magnetron generator in bandwidths outside of the optical range, and are considered part of the invention.

Figure 15:
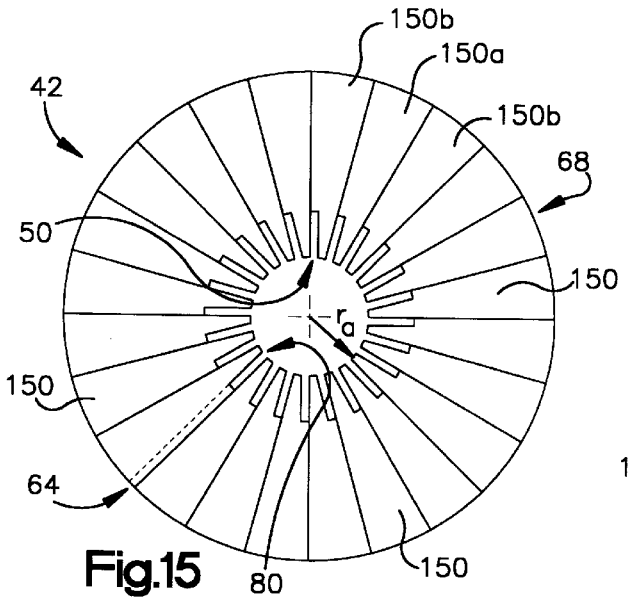
FIG. 15 is a top view of an anode structure formed in accordance with a wedge-based embodiment of the present invention.

In particular, FIGS. 15–18 represent an anode 42 in accordance with an alternate embodiment of the present invention. As is shown in FIG. 15, the anode 42 has a hollow-cylindrical shape with an inner surface 50 and an outer surface 68. Like the previous embodiments discussed above, a plurality N (where N is an even number) of slots or cavities 80 are formed along the inner surface 50. Again, the slots 80 serve as resonant cavities. The number and dimensions of the slots or cavities 80 depends on the desired operating wavelength $\lambda$ as discussed above. The anode 42 is formed by a plurality of pie-shaped wedge elements 150, referred to herein simply as wedges. When stacked side by side, the wedges 150 form the structure of the anode 42 as shown in FIG. 15.

Figure 16:
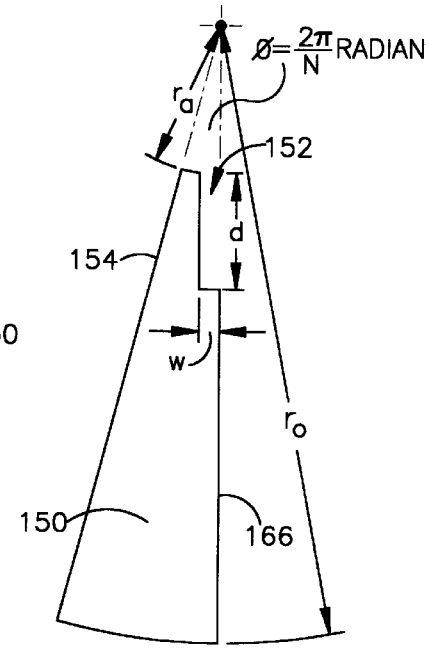
FIG. 16 is a top view of an exemplary wedge used to form the anode structure of FIG. 15 in accordance with the present invention.

FIG. 16 is a top view of an exemplary wedge 150. Each wedge 150 has an angular width $\phi$ equal to $(2\pi/N)$ radians, and an inner radius of ra equal to the inner radius ra of the anode 42. The outer radius ro of the wedge 150 corresponds to the outer radius ro of the anode 42 (i.e., the radial distance to the outer surface 68. Each wedge 150 further includes a recess 152 formed along the apex of the wedge 150 which defines, in combination with the side wall 154 of an adjacent wedge 150, one of the N resonant cavities 80.

As is shown in FIG. 16, each recess 152 has a length equal to d, which is equal to the depth of each resonant cavity 80. In addition, each recess 152 has a width w which is equal to the width of each resonant cavity 80. Thus, when stacked together side-by-side, the wedges 150 form N resonant cavities 80 around the inner surface 50 of the anode 42. The number N, depth, width and spacing therebetween of resonant cavities 80 is selected based on the desired operating wavelength as discussed above, and the dimensions of the wedges 150 are selected accordingly. The length L of each wedge 150 (see, e.g., FIG. 17), is set equal to the desired height of the anode 42 as will be appreciated.

Figure 17:
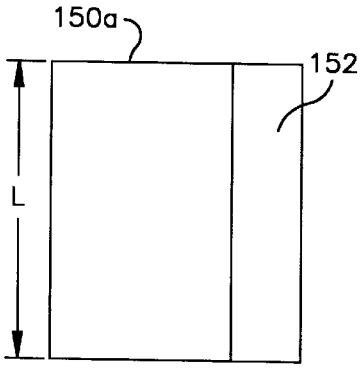
FIGS. 17 and 18 are side views of even and odd-numbered wedges, respectively, used to form the anode structure of FIG. 15 in accordance with the present invention.
Figure 18:
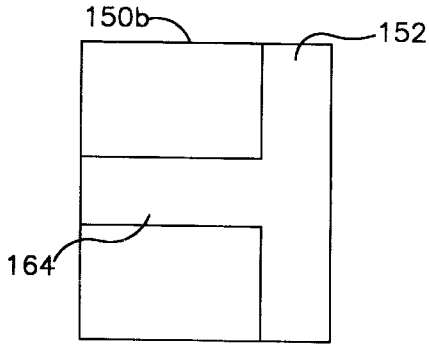

As in the embodiments discussed above, the wedges 150 may be nominally considered as even and odd-numbered wedges 150 arranged about the circumference of the anode 42. The even-numbered wedges 150 include a recess 152 to produce even-numbered cavities 80 and the odd-numbered wedges 150 include a recess 152 which produces odd-numbered cavities 80. FIGS. 17 and 18 show the front sides of even and odd-numbered wedges 150*a* and 150*b*, respectively. The front sides of the even-numbered and odd-numbered wedges 150*a* and 150*b* include a recess 152 as shown in FIGS. 17 and 18, respectively. In addition, however, each of the odd-numbered wedges 150*b* include a coupling port recess 164 as shown in FIG. 18. Each coupling port recess 164 in combination with the back side wall 154 of an adjacent wedge 150*a* forms a coupling port 64 acting as a single mode waveguide which serves to couple energy from the odd-numbered cavities 80 to a common resonant cavity 72. It is noted that only one of such coupling ports 64 is shown in FIG. 15 by way of example. As will be appreciated, the back side wall 154 of each wedge 150 is substantially planar as is the front side wall 166 of each wedge 150. Thus, the recesses 152 and 164 combine with the back side wall 154 of an adjacent wedge 150 to form a desired resonant cavity 80 and coupling port 64.

The wedges 150 may be made from various types of electrically conductive materials such as copper, aluminum, brass, etc., with plating (e.g., gold) if desired. Alternatively, the wedges 150 may be made of some non-conductive material which is plated with an electrically conductive material at least in the regions in which the resonant cavities 80 and coupling ports 64 are formed.

The wedges 150 may be formed using any of a variety of known manufacturing or fabrication techniques. For example, the wedges 150 may be machined using a precision milling machine. Alternatively, laser cutting and/or milling devices may be used to form the wedges. As another alternative, lithographic techniques may be used to form the desired wedges. The use of such wedges allows precision control of the respective dimensions as desired.

After the wedges 150 have been formed, they are arranged in proper order (i.e., even-odd-even-odd . . . ) to form the anode 42. The wedges 150 may be held in place by a corresponding jig, and the wedges soldered, brazed or otherwise bonded together to form an integral unit.

The embodiment of FIGS. 15–18 is analogous to the embodiment of FIG. 5 in that only the even/odd numbered cavities 80 include a coupling port 64, whereas the odd/even numbered cavities 80 do not include such a coupling port 64. The coupling of every other cavity 80 to the common resonant cavity 66 serves to induce pi-mode operation in the same manner.

Figure 19:
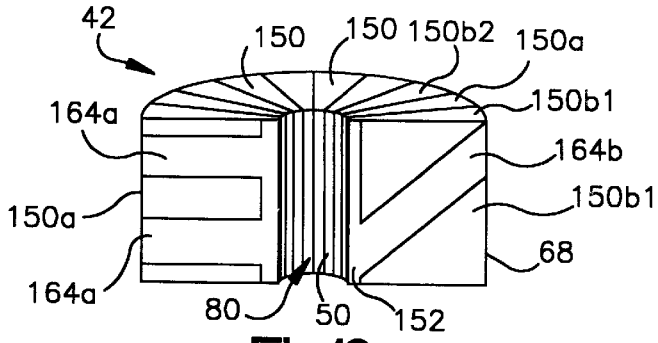
FIG. 19 is a schematic cross-sectional view of an H-plane bend embodiment of an anode structure in accordance with the present invention.
Figure 20:
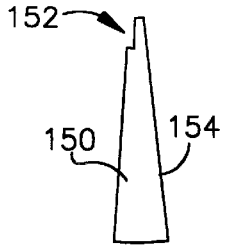
FIG. 20 is a top view of an exemplary wedge used to form the anode structure of FIG. 19 in accordance with the present invention.
Figure 21:
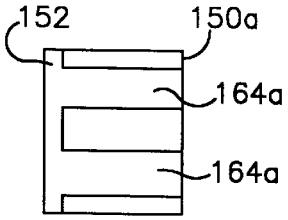
FIG. 21 is a side view of an even-numbered wedge used to form the anode structure of FIG. 19 in accordance with the present invention.

FIGS. 19–23 relate to another embodiment of an anode 42. Such embodiment is generally similar insofar as wedge-based construction, and hence only the differences will be discussed herein for sake of brevity. FIG. 19 illustrates the anode 42 in schematic cross section. In this particular embodiment, each resonant cavity 80 includes a coupling port or ports 64 each acting as a single mode waveguide for coupling energy between the resonant cavity 80 and one or more common resonant cavities 66 in order to induce further pi-mode operation. The coupling ports 64 formed by the odd-numbered wedges 150*b* introduce an additional ½λ delay in relation to the coupling ports 64 formed by the even-numbered wedges 150*a*, so as to provide the appropriate phase relationship.

FIG. 19 illustrates how the odd-numbered wedges 150*b* in this particular embodiment include a recess 164*b* which extends radially and at an angle in the H-plane direction between the recess 152 which forms the corresponding resonant cavity 80 and the outer surface 68 of the anode 42. The even-numbered wedges 150*a*, on the other hand, each include a pair of recesses 164*a* that each extend radially and perpendicular to the center axis between the recess 152 which forms the corresponding resonant cavity 80 and the outer surface 68. (It will be appreciated that the even-numbered wedge 150 as shown in FIG. 19 is flipped with respect to its intended orientation in order to provide a clear view of the recesses 164*a*).

The angle at which the recesses 164*b* are formed in the odd numbered wedges is selected so as each to introduce overall an additional ½λ delay compared to the recesses 164*a*. Thus, radiation which is coupled between the resonant cavities 80 formed by the even and odd-numbered wedges 150 will have the appropriate phase relationship with respect to the common resonant cavity 66.

Figure 22:
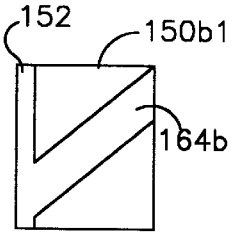
FIGS. 22 and 23 are side views of alternating odd-numbered wedges used to form the anode structure of FIG. 19 in accordance with the present invention.
Figure 23:
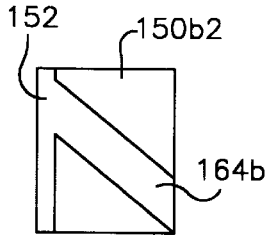

FIGS. 22 and 23 illustrate how the odd-numbered wedges 150*b* in the embodiment of FIG. 19 alternate between upwardly directed and downwardly directed angles. This allows for a more even distribution of the energy with respect to the axial direction within the anode-cathode space and the common resonant cavity 66 (not shown), as will be appreciated.

Figure 24:
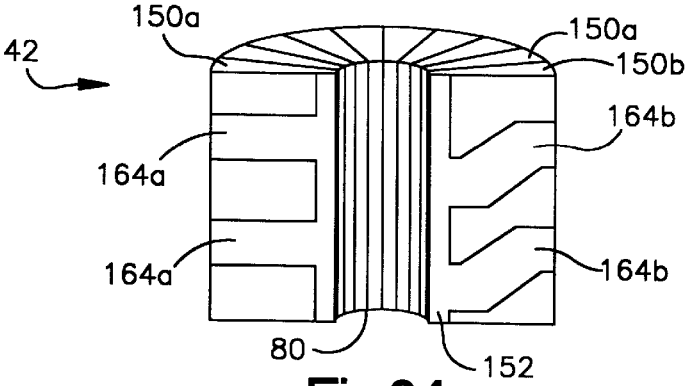
FIG. 24 is a schematic cross-sectional view of another H-plane bend embodiment of an anode structure in accordance with the present invention.
Figure 25:
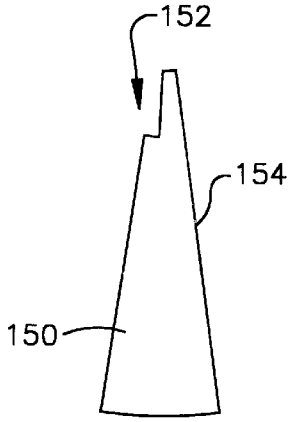
FIG. 25 is a top view of an exemplary wedge used to form the anode structure of FIG. 24 in accordance with the present invention.
Figure 26:
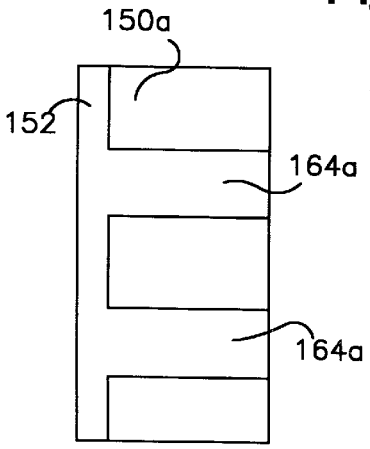
FIG. 26 is a side view of an even-numbered wedge used to form the anode structure of FIG. 24 in accordance with the present invention.
Figure 27:
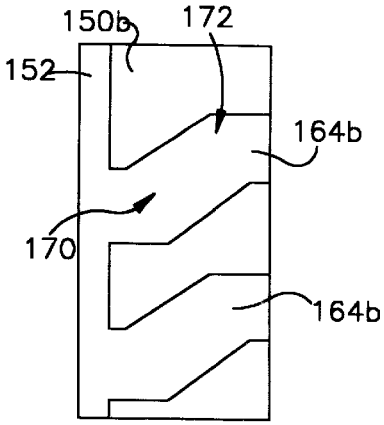
FIG. 27 is a side view of an odd-numbered wedge used to form the anode structure of FIG. 24 in accordance with the present invention.

FIGS. 24–27 illustrate another embodiment of the anode 42 using an H-plane bend of the coupling ports 64 formed by the odd-numbered wedges to introduce an additional ½λ delay relative to the coupling ports 64 formed by the even-numbered wedges. The even-numbered wedges 150*a* are similar to those in the embodiment of FIGS. 19–23. However, the odd-numbered wedges 150*b* include a pair of recesses 164*b* each presented at an angle relative to the H-plane. Each of the recesses 164*b* is designed to form a single mode waveguide in combination with the back side wall 154 of an adjacent wedge 150*a*. The recesses 164*b* are bent along the H-plane so as each to provide an additional ½λ delay compared to the recesses 164*a* in the even-numbered wedges. Consequently, the desired phase relationship between the resonant cavities 80 and one or more surrounding common resonant cavities 66 (not shown) is provided for pi-mode operation. Moreover, because each of the recesses 164*b* include a pair of bends 170 and 172, the coupling ports 64 formed by the recesses are generally evenly distributed along the axial direction of the anode 42. Thus, such an embodiment may be more favorable than the embodiment of FIGS. 19–23 which called for two different odd-numbered wedges 150*b*1 and 150*b*2. It will also be appreciated that again the even-numbered wedge 150*a* as shown in FIG. 24 is flipped with respect to its intended orientation in order to provide a clear view of the recesses 164*a*.

Figure 28:
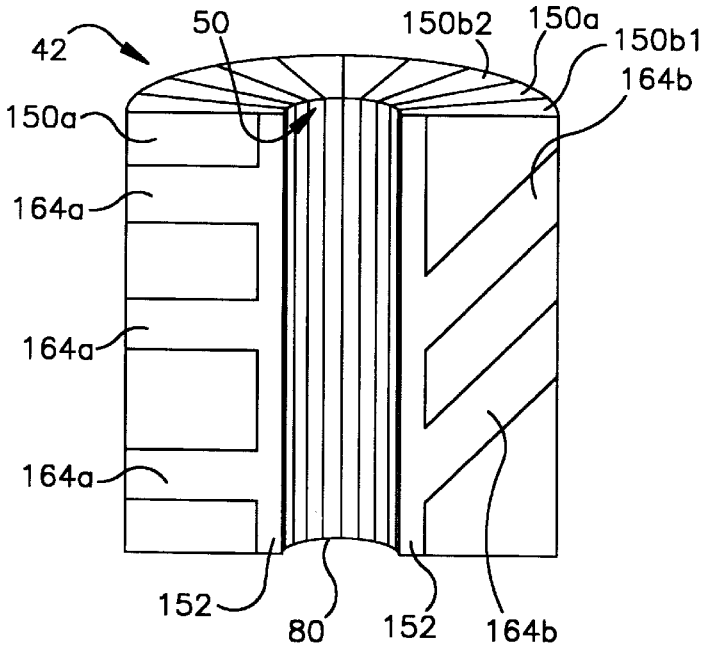
FIG. 28 is a schematic cross-sectional view of another H-plane bend embodiment of an anode structure in accordance with the present invention.
Figure 29:
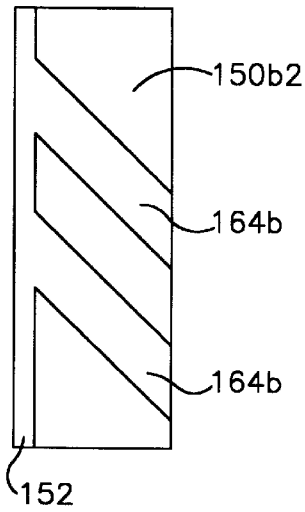
FIG. 29 is a side view of every other odd-numbered wedge used to form the anode structure of FIG. 28.
Figure 30:
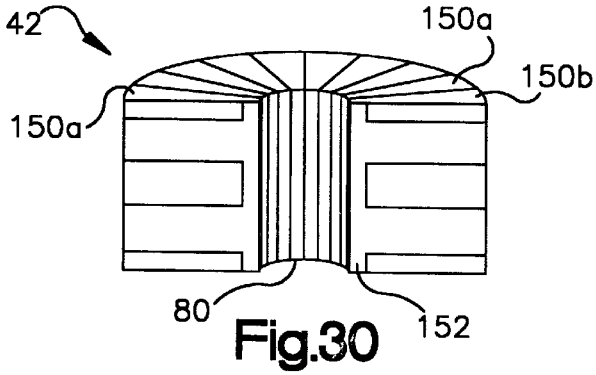
FIG. 30 is a schematic cross-sectional view of a dispersion-based embodiment of an anode structure in accordance with the present invention.
Figure 31:
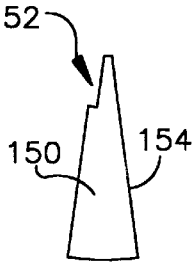
FIG. 31 is a top view of an exemplary wedge used to form the anode structure of FIG. 30 in accordance with the present invention.
Figure 32:
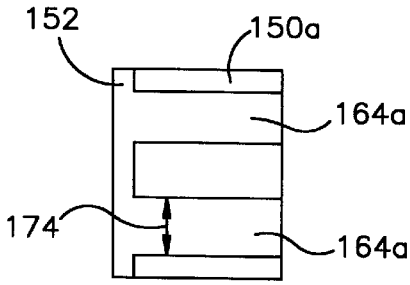
FIGS. 32 and 33 are side view of even and odd-numbered wedges used to form the anode structure of FIG. 30 in accordance with the present invention.
Figure 33:
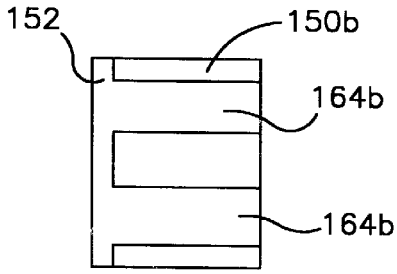

FIGS. 28 and 29 illustrate yet another embodiment of a wedge-based construction of an anode 42. This embodiment differs from the embodiment of FIGS. 19–23 in the following manner. The even-numbered wedges 150*a* include three recesses 164*a* rather than two. The odd-numbered wedges 150*b*1 and 150*b*2 include two recesses 164*b* rather than one. As will be appreciated, the number of recesses 164 formed in the respective wedges 150 is not limited to any particular number in accordance with the present invention. The number of recesses 164 may be selected based on the desired amount of coupling between the anode-cathode space and the common resonant cavity or cavities 66, as will be appreciated. It will again be appreciated that the even-numbered wedge 150*a* as shown in FIG. 28 is flipped with respect to its intended orientation in order to provide a clear view of the recesses 164*a*.

Referring now to FIGS. 30–33, yet another embodiment of an anode 42 is presented which utilizes an additional ½λ delay in the coupling ports 64 formed by the even-numbered wedges 150*a* compared to the odd-numbered wedges 150*b* to induce pi-mode operation. In this embodiment, however, the additional ½λ delay is provided by adjusting the relative width of the recesses 164 (as compared to introducing an H-plane bend). More particularly, each odd-numbered wedge 150*b* includes a pair of recesses 164*b* which combine with the back side wall 154 of an adjacent wedge 150*a* to form single mode waveguides serving as coupling ports 64. The even-numbered wedges 150*a*, on the other hand, include recesses 164*a* which have a width 174 that is relatively wider than that of the recesses 164*b*. As is known from waveguide theory, an appropriately selected wider width 174 of the recesses 164*a* may be chosen to provide for an additional ½λ delay compared to that of the recesses 164*b*. Thus, the desired phase relationship between the coupling ports 64 formed by the odd-numbered and even-numbered wedges may be obtained for pi-mode operation.

Figure 34:
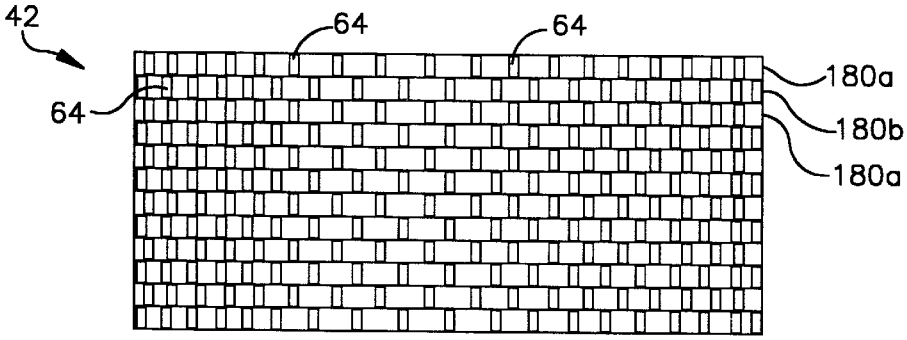
FIG. 34 is a side view of an E-plane bend embodiment of an anode structure in accordance with the present invention.

FIGS. 34–38 relate to an embodiment of the anode 42 which utilizes bends in the E-plane of the coupling ports 64 to provide the desired additional ½λ delay for pi-mode operation. As is shown in FIG. 34, the anode 42 is made up of several layers 180 stacked on top of each other with or without a spacer member (not shown) therebetween. The layers 180 are nominally referred to as either an even-numbered layer 180*a* or an odd-numbered layer 180*b* which alternate within the stack. The even-numbered layers 180*a* include linear waveguides forming coupling ports 64 which serve to couple energy between the anode-collector space and one or more common resonant cavities 66 (not shown). The odd-numbered layers 180*b* include waveguides which are curved in the E-plane and form coupling ports 64 which also serve to couple energy between the anode-collector space and the one or more common resonant cavities 66. The waveguides in the odd-numbered layers 180*b* are curved so as to introduce an additional ½λ delay compared to the waveguides in the even-numbered layers 180*a* to provide the desired pi-mode operation.

Figure 35:
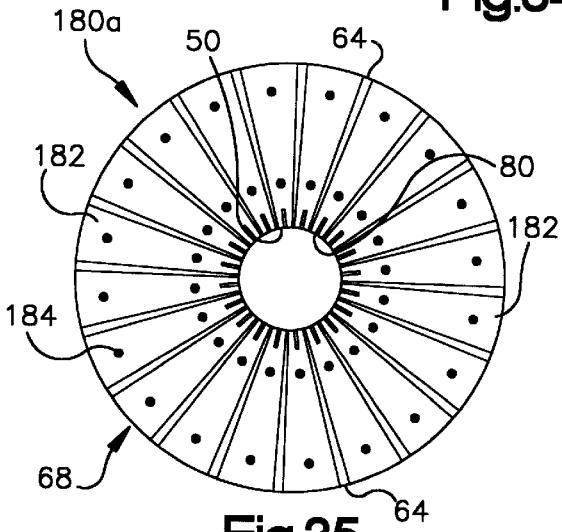
FIG. 35 is a top view of a linear E-plane layer used to form the anode structure of FIG. 34 in accordance with the present invention.
Figure 36:
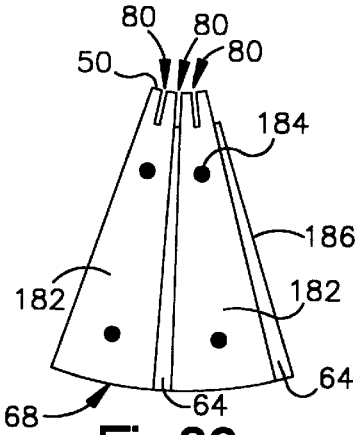
FIG. 36 is an enlarged view of a portion of the linear E-plane layer of FIG. 35 in accordance with the present invention.

FIGS. 35 and 36 illustrate an exemplary even-numbered layer 180*a*. Each layer 180*a* is made up of N/2 guide elements 182, where N is the desired number of resonant cavities 80 as above. The guide elements 182 are each formed in the shape of a wedge as shown in FIG. 36. The guide elements 182 are arranged side by side as shown in FIG. 35 to form a layer which defines the inner surface 50 and outer surface 68 of the anode 42. The tip of each wedge includes a slot which defines a resonant cavity 80 therein. In addition, adjacent guide elements 182 are spaced apart so as to form a resonant cavity 80 therebetween as shown in FIG. 36. As will be appreciated, the resonant cavities 80 formed in each of the layers 180 are to be aligned when the layers 180 are stacked together. Aligning holes or marks 184 may be provided in the elements 182 to aid in such alignment between layers.

As best shown in FIG. 36, the space between the guide elements 182 defines a radial tapered waveguide which serves as a coupling port 64 between an even-numbered resonant cavity 80 and the outer surface 68 of the anode 42. The thickness of the guide elements 182 is provided such that the coupling ports 64 have an H-plane height corresponding to the desired operating wavelength λ. Similarly, the dimensions of the resonant cavities 80 and the spacing between the guide elements 182 are selected for the desired wavelength λ.

The guide elements 182 are made of a conductive material such as copper, polysilicon, etc. so as to define the conductive walls of the resonant cavities and coupling ports 64. Alternatively, the guide elements 182 may be made of a non-conductive material with conductive plating at least at the portions defining the walls of the resonant cavities and coupling ports 64.

A spacer element 186 (shown in part in FIG. 36) is formed between adjacent layers 180 in the stack making up the anode 42. The spacer 186 is conductive at least in relevant part to provide the conductive E-plane walls of the coupling ports 64 in the layers 180. The spacer 186 may be washer shaped with an inner radius equal to the inner radius ra of the anode 42.

Figure 37:
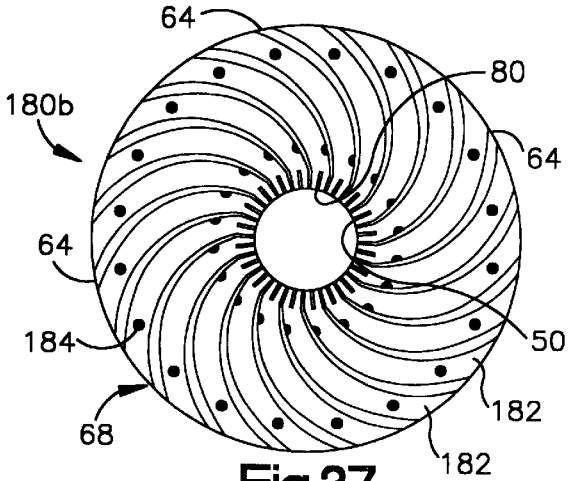
FIG. 37 is a top view of a curved E-plane layer used to form the anode structure of FIG. 34 in accordance with the present invention.
Figure 38:
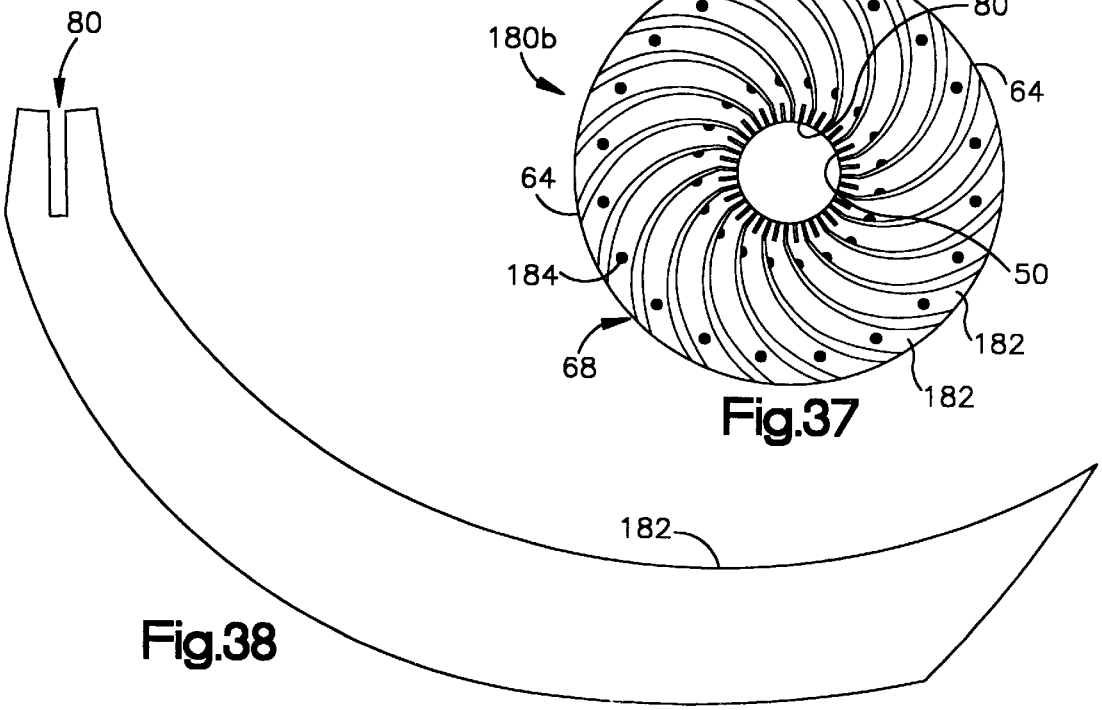
FIG. 38 is an enlarged view of a portion of the curved E-plane layer of FIG. 37.

FIGS. 37 and 38 illustrate an exemplary odd-numbered layer 180*b*. The odd-numbered layer 180*b* is similar in construction to that of the even-numbered layer with the exception that the guide elements 182 are curved to provide a desired bend in the E-plane direction of tapered waveguides forming the coupling ports 64. The particular radius of curvature of the bend is calculated to provide the desired additional ½λ delay relative to the coupling ports 64 of the even-numbered layers 180*a* for pi-mode operation. Also, the coupling ports 64 in the odd-numbered layers 180*b* serve to couple the odd-numbered resonant cavities 80 to the outer surface 68 of the anode 42, rather than the even-numbered resonant cavities 80 as in the even-numbered layers 180*a*.

The embodiment of FIGS. 34–38 is particularly well suited to known photolithographic fabrication methods as will be appreciated. A large anode 42 may be built up from layers 180*b* of E-plane bends interposed between layers 180*a* of straight waveguides. The layers may be formed and built up using photolithographic techniques. The appropriate dimensions for operation even at higher optical wavelengths can be achieved with the desired resolution. The guide elements 182 may be formed of copper or polysilicon, for example. The waveguides forming the coupling ports 64 may be filled with a suitable dielectric to provide planarization between layers 180 if desired. The spacers 186 between layers 180 may be formed of copper, polysilicon, etc., as will be appreciated.

In another embodiment, the layers 180 are generally identical with coupling ports 64 leading from each of the resonant cavities 80 radially outward to the outer surface 68 of the anode. In this case, however, the height of the coupling ports 64 corresponding to the odd-numbered resonant cavities 80 is greater than the height of the coupling ports 64 corresponding to the even-numbered resonant cavities 80. The difference in height corresponds to a difference in width as discussed above in relation to the embodiment of FIGS. 30–33, and is provided so as to produce the desired additional ½λ delay relative to the coupling ports 64 of the even-numbered resonant cavities 80 for pi-mode operation.

It will therefore be appreciated that the optical magnetron generator of the present invention is suitable for converting optical radiation to electrical power. The optical magnetron generator of the present invention is capable of producing high efficiency power conversion at frequencies within the microwave, infrared and visible light bands, and which may extend beyond into higher frequency bands such as ultraviolet, x-ray, etc. As a result, the optical magnetron generator of the present invention may serve as an electrical power source in a variety of applications.

For example, power in the form of optical radiation may be beamed to satellites or aircraft from ground stations. An on-board optical magnetron generator serves to convert the optical radiation into electric power which may be used as needed. Similarly, power from orbiting power stations may be transmitted in the form of optical radiation to an optical magnetron generator on earth. Such optical radiation is converted into electrical power as an alternative to environmentally damaging sources of energy.

Although the invention has been shown and described with respect to certain preferred embodiments, it is obvious that equivalents and modifications will occur to others skilled in the art upon the reading and understanding of the specification. For example, although slots are provided as the simplest form of resonant cavity, other forms of resonant cavities may be used within the anode without departing from the scope of the invention.

Furthermore, although the preferred techniques for providing pi-mode operation have been described in detail, other techniques are also within the scope of the invention. For example, cross coupling may be provided between slots. The slots 80 are spaced by ½λ and coupling channels are provided between adjacent slots 80. The coupling channels from slot to slot measure ⅜λ. In another embodiment, a plurality of optical resonators are embedded around the circumference of the anode structure with non-adjacent slots constrained to oscillate out of phase by coupling to a single oscillating mode in a corresponding one of the optical resonators. Other means will also be apparent based on the description herein.

Additionally, it will be appreciated that the toroidal resonators described herein which employ curved surfaces and TEM modes to control pi-mode oscillation may be utilized in otherwise conventional magnetrons.

The present invention includes all such equivalents and modifications, and is limited only by the scope of the following claims.

What is claimed is:

1. An optical magnetron generator, comprising:

an anode and a collector separated by an anode-collector space;

a pair of output terminals operatively coupled to the anode and the collector to provide an electrical power output based on an electric field generated across the anode-collector space;

at least one magnet arranged to provide a dc magnetic field within the anode-collector space generally normal to the electric field;

a plurality of resonant cavities each having an opening along a surface of the anode which defines the anode-collector space;

an input for receiving electromagnetic radiation from an external source and operatively configured to introduce the optical radiation into the anode-cathode space to establish a resonant electromagnetic field within the resonant cavities; and a cathode for introducing electrons into the anode-collector space in proximity to the resonant electromagnetic field, wherein the resonant electromagnetic field accelerates the electrons within the anode-collector space towards the collector onto which at least a portion of the electrons are collected.

2. The magnetron generator of claim 1, wherein the resonant cavities are each designed to resonate at a frequency having a wavelength λ of approximately 10 microns or less.

3. The magnetron generator of claim 1, wherein the plurality of resonant cavities comprises a plurality of radial slots of substantially equal depth formed in the anode.

4. The magnetron generator of claim 1, wherein the plurality of resonant cavities comprises alternating radial slots of at least two different depths formed in the anode.

5. The magnetron generator of claim 1, wherein the plurality of resonant cavities comprises a plurality of radial slots, and at least some of the plurality of radial slots are coupled to a common resonator.

6. The magnetron generator of claim 5, wherein the common resonator comprises at least one common resonant cavity around an outer circumference of the anode.

7. The magnetron generator of claim 6, wherein the common resonator comprises a single common resonant cavity and among the plurality of radial slots formed in the anode only every other one is coupled to the resonant cavity.

8. The magnetron generator of claim 6, wherein the common resonator comprises a plurality of common resonant cavities around the outer circumference of the anode.

9. The magnetron generator of claim 8, wherein among the plurality of radial slots formed in the anode, odd-numbered slots are coupled to a first of the plurality of common resonant cavities and even-numbered slots are coupled to a second of the plurality of common resonant cavities.

10. The magnetron generator of claim 6, wherein the common resonant cavity has a curved surface defining an outer wall of the cavity.

11. The magnetron generator of claim 1, wherein at least one of the plurality of resonant cavities is coupled to the input to input the electromagnetic radiation having a wavelength λ.

12. The magnetron generator of claim 11, wherein the input comprises a window transparent to incoming electromagnetic radiation having the wavelength λ.

13. A power transmission system comprising:

an optical magnetron generator according to claim 1; and means for providing the electromagnetic radiation to the input.

14. An optical magnetron generator, comprising:

a cylindrical collector having a radius rc;

an annular-shaped anode having a radius ra and coaxially aligned with the collector to define an anode-collector space having a width wa=ra−rc;

a pair of output terminals operatively coupled to the anode and the collector to provide an electrical power output based on an electric field generated across the anode-collector space;

at least one magnet arranged to provide a dc magnetic field within the anode-collector space generally normal to the electric field;

a plurality of resonant cavities each having an opening along a surface of the anode which defines the anode-collector space;

an input for receiving electromagnetic radiation from an external source and operatively configured to introduce the optical radiation into the anode-cathode space to establish a resonant electromagnetic field within the resonant cavities; and a cathode for introducing electrons into the anode-collector space in proximity to the resonant electromagnetic field, wherein the electrons introduced by the cathode are influenced by the resonant electromagnetic field and the magnetic field to accelerate along a path through the anode-collector space which curves towards the collector.

15. The magnetron generator of claim 14, wherein the resonant cavities are each designed to resonate at a frequency having a wavelength λ, and a circumference 2 π ra of the surface of the anode is greater than λ.

16. The magnetron generator of claim 14, wherein the plurality of resonant cavities comprises a plurality of radial slots of substantially equal depth formed in the anode.

17. The magnetron generator of claim 14, wherein the plurality of resonant cavities comprises alternating radial slots of at least two different depths formed in the anode.

18. The magnetron generator of claim 14, wherein the plurality of resonant cavities comprises a plurality of radial slots, and at least some of the plurality of radial slots are coupled to a common resonator.

19. The magnetron generator of claim 18, wherein the common resonator comprises at least one common resonant cavity around an outer circumference of the anode.

20. The magnetron generator of claim 19, wherein the common resonator comprises a single common resonant cavity and among the plurality of radial slots formed in the anode only every other one is coupled to the resonant cavity.

21. The magnetron generator of claim 19, wherein the common resonator comprises a plurality of common resonant cavities around the outer circumference of the anode.

22. The magnetron generator of claim 21, wherein among the plurality of radial slots formed in the anode, odd-numbered slots are coupled to a first of the plurality of common resonant cavities and even-numbered slots are coupled to a second of the plurality of common resonant cavities.

23. The magnetron generator of claim 19, wherein the common resonant cavity has a curved surface defining an outer wall of the cavity.

24. The magnetron generator of claim 14, wherein at least one of the plurality of resonant cavities is coupled to at least one output port to output electromagnetic energy having a wavelength λ.

25. The magnetron generator of claim 24, wherein the output port comprises an output window generally transparent to electromagnetic energy having the wavelength λ.

26. The magnetron generator of claim 14, wherein the plurality of resonant cavities are configured to induce pi-mode resonance.

* * * * *